US008463171B2

(12) United States Patent
Katano et al.

(10) Patent No.: US 8,463,171 B2
(45) Date of Patent: Jun. 11, 2013

(54) FIXING SOLUTION, FIXING METHOD, FIXING DEVICE, IMAGE FORMING METHOD AND IMAGE FORMING APPARATUS

(75) Inventors: Yasuo Katano, Kanagawa (JP); Tsuneo Kurotori, Tokyo (JP); Yuko Arizumi, Kanagawa (JP); Shigeo Takeuchi, Kanagawa (JP); Hidekazu Yaginuma, Kanagawa (JP); Fuminari Kaneko, Tokyo (JP); Yukimichi Someya, Saitama (JP); Shigenobu Hirano, Kanagawa (JP); Hidenori Tomono, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 387 days.

(21) Appl. No.: 12/825,683

(22) Filed: Jun. 29, 2010

(65) Prior Publication Data

US 2011/0002718 A1 Jan. 6, 2011

(30) Foreign Application Priority Data

Jul. 1, 2009 (JP) ..... 2009-156848
Mar. 15, 2010 (JP) ..... 2010-058223
Jun. 22, 2010 (JP) ..... 2010-141608

(51) Int. Cl.
*G03G 15/20* (2006.01)

(52) U.S. Cl.
USPC ..... 399/340

(58) Field of Classification Search
USPC ..... 399/340; 430/124.21
See application file for complete search history.

(56) References Cited

U.S. PATENT DOCUMENTS

| | | | | |
|---|---|---|---|---|
| 6,947,700 | B2 * | 9/2005 | Kurotori et al. | 399/340 |
| 7,460,823 | B2 * | 12/2008 | Asakura et al. | 399/340 |
| 7,747,207 | B2 * | 6/2010 | Tanaka et al. | 399/340 |
| 7,904,011 | B2 * | 3/2011 | Arizumi et al. | 399/340 |
| 2006/0263712 | A1 * | 11/2006 | Katano et al. | 430/124 |
| 2007/0243483 | A1 * | 10/2007 | Katano et al. | 430/124.21 |
| 2007/0253757 | A1 * | 11/2007 | Tanaka et al. | 399/340 |
| 2008/0063446 | A1 | 3/2008 | Katano et al. | |
| 2008/0145775 | A1 * | 6/2008 | Vijayendran et al. | 430/109.3 |
| 2008/0213002 | A1 | 9/2008 | Katano et al. | |
| 2009/0003903 | A1 | 1/2009 | Katano et al. | |
| 2009/0067904 | A1 * | 3/2009 | Katano et al. | 399/340 X |

FOREIGN PATENT DOCUMENTS

| | | | |
|---|---|---|---|
| EP | 1956444 | A1 | 8/2008 |
| EP | 2009515 | A2 | 12/2008 |
| JP | 59-119364 | | 7/1984 |
| JP | 3168118 | | 3/2001 |
| JP | 3290513 | | 3/2002 |
| JP | 2003-156870 | | 5/2003 |
| JP | 3509192 | | 1/2004 |

(Continued)

OTHER PUBLICATIONS

Sep. 17, 2010 European search report in connection with a counterpart European patent application No. 10167906.

*Primary Examiner* — Sandra Brase
(74) *Attorney, Agent, or Firm* — Cooper & Dunham LLP

(57) ABSTRACT

To provide a fixing solution for fixing fine resin particles to a recording medium, the fixing solution including: a diluent which contains water; a foaming agent which allows the fixing solution to be in the form of foam; and a solid plasticizer which is solid at normal temperature and soluble in the diluent, and which softens or swells at least part of the fine resin particles while dissolved in the diluent.

12 Claims, 9 Drawing Sheets

FOREIGN PATENT DOCUMENTS

| | | |
|---|---|---|
| JP | 2005-274879 | 10/2005 |
| JP | 2007-17611 | 1/2007 |
| JP | 2007-219105 | 8/2007 |
| JP | 4027188 | 10/2007 |
| JP | 4185742 | 9/2008 |
| JP | 4302700 | 5/2009 |

* cited by examiner

FIXING SOLUTION, FIXING METHOD, FIXING DEVICE, IMAGE FORMING METHOD AND IMAGE FORMING APPARATUS

BACKGROUND OF THE INVENTION

1. Field of the Invention

The present invention relates to a fixing solution and also to a fixing method, a fixing device, an image forming method, and an image forming apparatus which use the fixing solution.

2. Description of the Related Art

Image forming apparatuses such as printers, facsimiles and copiers are apparatuses which form images including letters, characters and symbols on recording media such as paper, cloth and OHP sheets based upon image information. Electrophotographic image forming apparatuses, in particular, are capable of forming high-definition images on plain paper at high speed, and so they are widely used in offices and the like. In such electrophotographic image forming apparatuses, thermal fixing methods are widely used in which toner on recording media is heated and melted and the melted toner is fixed onto the recording media by application of pressure. These thermal fixing methods are favorably used because they offer high fixing speed and high fixed image quality.

The power consumption in these electrophotographic image forming apparatuses is largely accounted for by the heating of the toner in the thermal fixing methods. In view of the tackling of environmental problems which has been attracting attention in recent years, there is much need for provision of low-power-consumption (energy-saving) fixing devices. Specifically, there is much need for provision of fixing methods for dramatically lowering the temperature at which toner is heated for its fixation, or fixing methods which do not necessitate heating toner. In particular, non-thermal fixing methods in which toner is fixed to recording media without heating the toner at all are ideal in that low power consumption can be achieved. Regarding the non-thermal fixing methods, those which use solvent have been proposed. However, since such fixing methods which use solvent involve swelling or melting toner, they present problems of offset and the remaining presence of tack in the non-thermal fixing methods.

To prevent the offset, various methods have been proposed. A first method is a method of improving separability of a surface layer of a fixing member by providing the surface layer with an offset-preventing layer made of a material which enables high separability. A second method is a method of improving separability of a fixing member by applying a release agent such as silicone oil to a surface layer of the fixing member. A third method is a method of applying to a fixing member a direct-current bias which has the same polarity as toner of an unfixed image borne on a recording medium and thus preventing attachment of the toner to the fixing member. A fourth method is a method of removing toner attached to a surface layer of a fixing member, by providing a certain rubbing cleaning unit. Further, there are methods of preventing the offset by combining these methods, etc. Also, hardening of ink by means of light or heat, coating with a member which enables separability, and the like have been proposed as methods of removing or reducing tack.

For example, Japanese Patent Application Laid-Open (JP-A) Nos. 2003-156870 and 2005-274879 and Japanese Patent (JP-B) No. 4027188 each propose a method, etc. which is a combination of the above-mentioned first method, the above-mentioned second method and other method(s) to prevent offset and the like. However, since the fixing methods described in these proposals are thermal fixing methods, the problems of offset and the remaining presence of tack in non-thermal fixation cannot be solved.

JP-B Nos. 3509192 and 3168118 propose methods of removing or reducing tack by hardening ink with ultraviolet light or heat. However, since the methods described in these proposals employ thermal fixing methods, the problems of offset and the remaining presence of tack in non-thermal fixation cannot be solved.

JP-A No. 2007-017611 proposes a fixing solution enabled to reduce generation of additive odor, suppress disturbance to toner images and fix toner at high speed, by adding a specific water-soluble resin to the fixing solution; and a fixing device configured to fix toner, using the fixing solution. However, if the water-soluble resin described in this proposal is added, the foamability and foam stability of a fixing solution degrade noticeably and thus it is impossible to obtain a foamy fixing solution.

JP-A No. 2007-219105 proposes providing a foamy fixing solution to resin-containing fine particles such as toner particles on a medium such as paper. By doing so, it is possible to avoid disturbance to a fine resin particle layer on the medium, the fine resin particles are quickly fixed to the medium after the application of the fixing solution to the medium where the fine resin particles are attached, and further, the fixing solution can be applied in small amounts to such an extent that residual liquid is not felt on the medium. However, this proposal causes tack to remain when an image portion is formed with the amount of the fixing solution applied being very large, for example when the amount of toner attached varies over the same sample.

In the case of color images, as opposed to the case of monochrome images, when grain boundaries exist between toner particles, light incident on toner layers scatters and thus it is difficult to exhibit the color reproducibility required for the fixed images. Means for exhibiting the color reproducibility include a means of increasing the amount of a fixing solution applied. However, if the amount of the fixing solution applied is increased, tack may possibly remain as mentioned above. This occurrence is noticeable in the case of color images where the amount of toner tends to be unevenly distributed. Accordingly, a fixing solution has been in demand which is capable of forming a uniform film-like fixed image, with the amount of the fixing solution applied being small and without creating grain boundaries between toner particles.

BRIEF SUMMARY OF THE INVENTION

The present invention provides a fixing solution with favorable fixing properties for use with fine resin particles, and the fixing solution is capable of reducing tack (caused by fine resin particles such as toner particles on a recording medium in a non-thermal fixing method) and forming a fixed image superior in color reproducibility. The present invention also provides a fixing method, a fixing device, an image forming method, and an image forming apparatus which use the fixing solution.

As a result of carrying out earnest examinations in an attempt to solve the problems, the present inventors have found that use of a foaming agent (which allows a fixing solution to be in the form of foam) and a solid plasticizer (as an agent which softens fine resin particles) makes it possible to solve the problems effectively.

The present invention is based upon the above-mentioned findings of the present inventors, and means for solving the problems are as follows.

<1> A fixing solution for fixing fine resin particles to a recording medium, the fixing solution including: a diluent which contains water; a foaming agent which allows the fixing solution to be in the form of foam; and a solid plasticizer which is solid at normal temperature and soluble in the diluent, and which softens or swells at least part of the fine resin particles while dissolved in the diluent.

<2> The fixing solution according <1>, wherein the solid plasticizer contains a functional group which has an affinity for the fine resin particles.

<3> The fixing solution according to <1> or <2>, wherein the solid plasticizer is a compound which contains at least one of an ethylene oxide group and a propylene oxide group.

<4> The fixing solution according to <3>, wherein the compound which contains the ethylene oxide group is any one of the compounds represented by General Formulae (1) to (5) below:

$$HO—(CH_2CH_2O)_n—H \quad (1)$$

where n denotes an integer of 10 to 100, $$HO—(CH_2CH_2O)_n(CH(CH_3)CH_2O)_m—H \quad (2)$$

where n denotes an integer of 10 to 200, and m denotes an integer of 5 to 50, $$R—O—(CH_2CH_2O)_n—H \quad (3)$$

where n denotes an integer of 10 to 100, $$R—COO—(CH_2CH_2O)_n—H \quad (4)$$

where R denotes a C10-C22 straight-chain or branched alkyl group, and n denotes an integer of 10 to 100, $$R—COO—(CH_2CH_2O)_n—CO—R' \quad (5)$$

where R and R' each independently denote a C10-C22 straight-chain or branched alkyl group, and n denotes an integer of 10 to 100.

<5> The fixing solution according to <4>, wherein the compound is polyethylene glycol which has a weight average molecular weight of 1,000 to 10,000.

<6> The fixing solution according to any one of <1> to <5>, wherein the fine resin particles are particles of a polyester resin having at least one of an ethylene oxide group and a propylene oxide group in a resin molecule.

<7> The fixing solution according to <6>, wherein the polyester resin is a polyol polyester resin.

<8> The fixing solution according to any one of <1> to <7>, wherein the fine resin particles constitute a toner.

<9> A fixing method including: rendering the fixing solution according to any one of <1> to <8> into the form of foam so as to produce a foamy fixing solution; adjusting the thickness of a layer of the foamy fixing solution such that the layer having a desired thickness forms over a contact surface of a foamy fixing solution providing unit; and providing the formed layer of the foamy fixing solution having the desired thickness to a fine resin particle layer on a medium.

<10> A fixing device including: a foamy fixing solution producing unit configured to render the fixing solution according to any one of <1> to <8> into the form of foam so as to produce a foamy fixing solution; a foamy fixing solution providing unit configured to provide the foamy fixing solution to a fine resin particle layer on a medium; and a layer thickness adjusting unit configured to adjust the thickness of a layer of the foamy fixing solution on the foamy fixing solution providing unit.

<11> An image forming method including: forming a latent electrostatic image on a latent electrostatic image bearing member; developing the latent electrostatic image with the use of a developer including a toner which contains fine resin particles so as to form a visible image; transferring the visible image to a recording medium; and fixing the transferred image to the recording medium, wherein the fixing is performed by the fixing method according to <9>.

<12> The image forming method according to <11>, further including warming the fine resin particle layer provided with the foamy fixing solution.

<13> An image forming apparatus including: a latent electrostatic image bearing member; a latent electrostatic image forming unit configured to form a latent electrostatic image on the latent electrostatic image bearing member; a developing unit configured to develop the latent electrostatic image with the use of a developer including a toner which contains fine resin particles so as to form a visible image; a transfer unit configured to transfer the visible image to a recording medium; and a fixing unit configured to fix the transferred image to the recording medium, wherein the fixing unit is the fixing device according to <10>.

<14> The image forming apparatus according to <13>, further including a warming unit configured to warm the fine resin particle layer provided with the foamy fixing solution.

<15> The fixing method according to <9>, further including warming the fine resin particle layer provided with the foamy fixing solution.

<16> The fixing method according to <9> or <15>, wherein the solid plasticizer has a weight average molecular weight of 2,000 to 10,000.

<17> The fixing method according to any one of <9>, <15> and <16>, wherein the fine resin particles are particles of a polyester resin having at least one of an ethylene oxide group and a propylene oxide group in a resin molecule.

<18> The fixing method according to any one of <9>, and <15> to <17>, wherein the polyester resin is a polyol polyester resin.

<19> The fixing method according to any one of <9>, and <15> to <18>, wherein the fine resin particles constitute a toner.

<20> The fixing device according to <10>, further including a warming unit configured to warm the fine resin particle layer provided with the foamy fixing solution.

<21> The fixing method according to <10> or <20>, wherein the solid plasticizer has a weight average molecular weight of 2,000 to 10,000.

<22> The fixing device according to any one of <10>, <20> and <21>, wherein the fine resin particles are particles of a polyester resin having at least one of an ethylene oxide group and a propylene oxide group in a resin molecule.

<23> The fixing device according to any one of <10>, and <20> to

<22>, wherein the polyester resin is a polyol polyester resin.

<24> The fixing device according to any one of <10>, and <20> to <23>, wherein the fine resin particles constitute a toner.

The present invention makes it possible to solve the above-mentioned problems in related art, provide a fixing solution with favorable fixing properties for use with fine resin particles, the fixing solution being capable of reducing tack (caused by fine resin particles such as toner particles on a recording medium in a non-thermal fixing method) and forming a fixed image superior in color reproducibility, and also provide a fixing method, a fixing device, an image forming method, and an image forming apparatus which use the fixing solution.

DETAILED DESCRIPTION OF THE INVENTION

Fixing Solution

Figure 1:
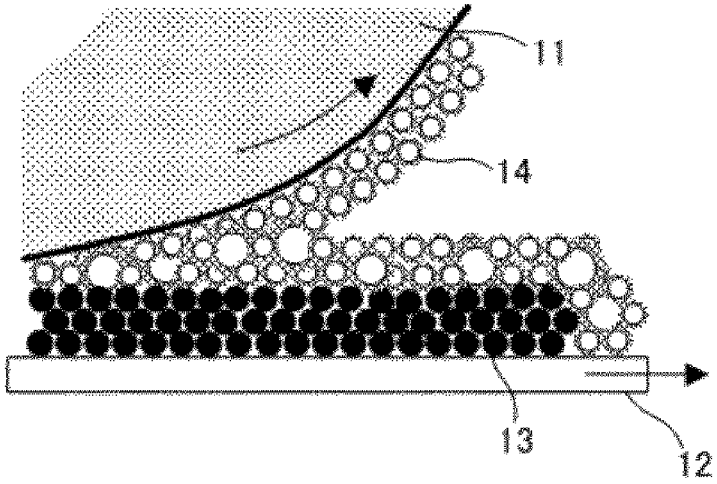
FIG. 1 is a schematic cross-sectional view showing how fine resin particles are fixed after the provision of a fixing solution of the present invention.

A fixing solution of the present invention includes a diluent, a foaming agent which allows the fixing solution to be in the form of foam, and a solid plasticizer which softens fine resin particles such as toner particles. If necessary, the fixing solution may further contain other component(s).

<Solid Plasticizer>

The solid plasticizer is not particularly limited as long as it is solid at normal temperature, soluble in the diluent, and capable of softening fine resin particles such as toner particles while dissolved in the diluent. Here, "normal temperature" means any temperature which can be reached without heating or cooling, and it is preferably in the range of 5° C. to 35° C. as defined in JIS Z8703, for example. In this normal temperature range, the solid plasticizer is in a solid state. Specifically, while present in the fixing solution that is in a state of foam, the solid plasticizer is in a melted state because of water contained in the fixing solution, whereas when the fixing solution is provided to unfixed toner and permeates the toner and then the amount of water in the fixing solution decreases due to its vaporization or the like, the solid plasticizer changes into a solid state. In the present invention, note is taken of the change of the solid plasticizer into a solid state, and utilization of this property makes it possible to enhance the hardness of the toner after the provision of the fixing solution and thus to solve the tack-related problems. Further, there exists the following favorable points: the solid plasticizer exhibits its capability of plasticizing fine resin particles under certain conditions at normal temperature; also, when the solid plasticizer loses its plasticizing capability and changes into a solid state, the solid plasticizer itself hardens and thereby contributes to prevention of tack.

The solid plasticizer preferably contains a functional group which has an affinity, for example constant compatibility, with the fine resin particles to be fixed. Here, the expression "a functional group which has an affinity with the fine resin particles" preferably means a case where a functional group contained in molecules constituting the fine resin particles is the same as the functional group contained in the solid plasticizer, or a case where the functional group contained in the solid plasticizer constantly interacts with the functional group contained in the molecules constituting the fine resin particles. When the functional group contained in the solid plasticizer constantly interacts with the functional group contained in the molecules constituting the fine resin particles, the interaction between these functional groups causes the solid plasticizer to enter between the molecules constituting the fine resin particles. As a result, a state of a so-called polymer blend is created between the solid plasticizer and the fine resin particles, which is effective when the solid plasticizer softens or swells at least part of the fine resin particles such as toner particles. As a specific example, the solid plasticizer is polyethylene glycol which includes a compound having an ethylene oxide group, and the corresponding fine resin particles have an ethylene oxide group in a resin molecule. In such a case, the solid plasticizer and the fine resin particles both have an ethylene oxide group, which enhances the affinity between the solid plasticizer and the fine resin particles and thus effectively enhances the compatibility between the solid plasticizer and the fine resin particles. It should be noted that this conception holds true as long as both the solid plasticizer and the fine resin particles have functional groups with an affinity for each other. Therefore, the ethylene oxide group does not necessarily have to be used, and a propylene oxide group may also be used as another example. Further, inclusion of a functional group (which is contained in a toner known in the art) in the solid plasticizer is also effective.

Examples of the solid plasticizer include those which exhibit their plasticizing capability under certain conditions (such as the compounds mentioned immediately below), besides those which satisfy the above-mentioned requirements.

[1] Solid plasticizers which exhibit their plasticizing capability when dissolved in the after-mentioned diluent:

Agents containing ethylene oxide groups, i.e. polyethylene glycols having weight average molecular weights of 1,000 to 2,000

[2] Solid plasticizers which do not exhibit their plasticizing capability when dissolved in the diluent but exhibit their plasticizing capability when the after-mentioned liquid plasticizer is present in small amounts:

Agents containing ethylene oxide groups, i.e. polyethylene glycols having weight average molecular weights of 2,000 to 10,000

[3] Solid plasticizers which do not exhibit their plasticizing capability when dissolved in the diluent but exhibit their plasticizing capability with slight warming (e.g. 50° C. to 100° C.):

Agents containing ethylene oxide groups, i.e. polyethylene glycols having weight average molecular weights of 2,000 to 10,000

Polyoxyethylene monoalkyl ethers, i.e. polyoxyethylene monolauryl ether, polyoxyethylene monocetyl ether, and the like Compounds having ethylene oxide groups (each of which is represented by "—($CH_2CH_2O$)—") and/or propylene oxide groups (each of which is represented by "—($CH(CH_3)CH_2O$)—") in their molecular chains, i.e. compounds which are solid at normal temperature and have melting points of 40° C. and higher, preferably 50° C. and higher, among compounds generally referred to as glycol ethers and glycol fatty acid esters More specifically, the polyoxyethylene glycols represented by General Formula (1) below are preferable.

$$HO—(CH_2CH_2O)_n—H \quad (1)$$

In General Formula (1), n denotes an integer of 10 to 100.

When n is less than 10, the polyoxyethylene glycols are not solid at room temperature. When n is greater than 100, the polyoxyethylene glycols have such large molecules that their plasticizing capability upon application of heat is low, thereby making it difficult for the toner to soften. Specific suitable examples of the polyoxyethylene glycols include polyethylene glycol #1000, polyethylene glycol #1540, polyethylene glycol #2000, polyethylene glycol #4000, polyethylene glycol #6000 and polyethylene glycol #8000.

The polyoxyethylene polyoxypropylene glycols represented by General Formula (2) below are also preferable.

$$HO—(CH_2CH_2O)_n(CH(CH_3)CH_2O)_m—H \quad (2)$$

In General Formula (2), n denotes an integer of 10 to 200, and m denotes an integer of 5 to 50.

When n is less than 10, the polyoxyethylene polyoxypropylene glycols are not solid at room temperature. When n is greater than 200, the polyoxyethylene polyoxypropylene glycols have such large molecules that their plasticizing capability upon application of heat is low, thereby making it difficult for the toner to soften. When m is less than 5, the polyoxyethylene polyoxypropylene glycols are not solid at room temperature. When m is greater than 50, the polyoxyethylene polyoxypropylene glycols have such large molecules that their plasticizing capability upon application of heat is low, thereby making it difficult for the toner to soften. Specific suitable examples of the polyoxyethylene polyoxypropylene glycols include EMULGEN 290 (manufactured by Kao Corporation); and EPAN 450, EPAN 750 and EPAN 785 (manufactured by DAI-ICHI KOGYO SEIYAKU CO., LTD.).

The polyoxyethylene alkyl ethers represented by General Formula (3) below are also preferable.

$$R—O—(CH_2CH_2O)_n—H \quad (3)$$

In General Formula (3), n denotes an integer of 10 to 100.

When n is less than 10, the polyoxyethylene alkyl ethers are not solid at room temperature. When n is greater than 100, the polyoxyethylene alkyl ethers have such large molecules that their plasticizing capability upon application of heat is low, thereby making it difficult for the toner to soften.

When the number of carbon atoms of the substituent denoted by R is less than 10, the polyoxyethylene alkyl ethers are unfavorably soft for solids, and there are safety problems caused such as skin irritation and eye irritation. When the number of carbon atoms of the substituent denoted by R is greater than 22, the plasticizing capability of the polyoxyethylene alkyl ethers upon application of heat is low, thereby making it difficult for the toner to soften.

Specific suitable examples of the polyoxyethylene alkyl ethers include EMULGEN 350, EMULGEN 420 and EMULGEN 4085 (manufactured by Kao Corporation); and EMALEX 611, EMALEX 620, EMALEX710 and EMALEX720 (manufactured by Nihon Emulsion Co., Ltd.).

The polyoxyethylene fatty acid esters and the polyoxyethylene fatty acid diesters represented by General Formulae (4) and (5) below respectively are also preferable.

$$R—COO—(CH_2CH_2O)_n—H \quad (4)$$

In General Formula (4), R denotes a C10-C22 straight-chain or branched alkyl group, and n denotes an integer of 10 to 100.

$$R—COO—(CH_2CH_2O)_n—CO—R' \quad (5)$$

In General Formula (5), R and R' each independently denote a C10-C22 straight-chain or branched alkyl group, and n denotes an integer of 10 to 100.

In General Formulae (4) and (5) above, when n is less than 10, the polyoxyethylene fatty acid esters and the polyoxyethylene fatty acid diesters are not solid at room temperature. When n is greater than 100, the polyoxyethylene fatty acid esters and the polyoxyethylene fatty acid diesters have such large molecules that their plasticizing capability upon application of heat is low, thereby making it difficult for the toner to soften.

When the number(s) of carbon atoms of the substituent(s) denoted by R and R' is/are less than 10, the polyoxyethylene fatty acid esters and the polyoxyethylene fatty acid diesters are unfavorably soft for solids, and there are safety problems caused such as skin irritation and eye irritation. When the number(s) of carbon atoms of the substituent(s) denoted by R and R' is/are greater than 22, the plasticizing capability of the polyoxyethylene fatty acid esters and the polyoxyethylene fatty acid diesters upon application of heat is low, thereby making it difficult for the toner to soften.

Specific suitable examples of the polyoxyethylene fatty acid esters and the polyoxyethylene fatty acid diesters include EMANON 3199V and EMANON 3299RV (manufactured by Kao Corporation); and EMALEX820 and EMALEX830 (manufactured by Nihon Emulsion Co., Ltd.).

When the weight average molecular weights of the polyethylene glycols mentioned as examples in [1] above are less than 1,000, fixed images may possibly melt depending upon the ambient environment. When the weight average molecular weights of the polyethylene glycols mentioned as examples in [1] above are greater than 2,000, they are not in a solid state at normal temperature, so that they may possibly be unable to sufficiently exhibit their plasticizing capability in a fixing solution which does not include the after-mentioned liquid plasticizer that is an optional component. In light of the foregoing technical understanding, their weight average molecular weights are preferably in the range of 1,000 to 2,000.

When the weight average molecular weights of the polyethylene glycols mentioned as examples in [2] above are greater than 10,000, they are clearly not in a solid state at normal temperature, so that grain boundaries may possibly be created between fine resin particles to be fixed. In light of this point, it has been made clear that it is difficult to use the polyethylene glycols with weight average molecular weights of 10,000 and greater in a fixing solution which does not include the after-mentioned liquid plasticizer, and it has been found that when the polyethylene glycols are used in a fixing solution which includes water, their weight average molecular weights should be in the range of 1,000 to 10,000.

The temperature at which the solid plasticizers mentioned as examples in [3] above are warmed is not particularly limited as long as their plasticizing capability can be exhibited; however, the temperature is preferably in the range of 50° C.

to 100° C. When the temperature is lower than 50° C., there may be a deficiency of fixation. When the temperature is higher than 100° C., it is uneconomical in terms of energy consumption.

The amount of the solid plasticizer included in the fixing solution is not particularly limited; however, the solid plasticizer preferably occupies 5% by mass to 30% by mass of the fixing solution. When the solid plasticizer occupies less than 5% by mass, there is difficulty in terms of fixation. When the solid plasticizer occupies more than 30% by mass, the fixing solution and the foamy fixing solution increase in viscosity, and also there are quality-related problems such as degradation of foaming and lack of foam stability.

<Foaming Agent>

The foaming agent included in the fixing solution of the present invention is not particularly limited as long as it allows the fixing solution to be in the form of foam. The foaming agent can realize superior foamability and foam stability. Examples of the foaming agent include saturated or unsaturated fatty acid salts, monoalkyl sulfates, alkylpolyoxyethylene sulfates, sulfonates such as alkylbenzene sulfonates, and anionic surfactants exemplified by phosphates such as monoalkyl phosphates.

—Fatty Acid Salt—

Among these foaming agents shown as examples, fatty acid salts are the best in terms of foam stability and so most suitable for the foaming agent of the fixing solution.

Among the fatty acid salts, preference is given to fatty acid sodium salts, fatty acid potassium salts and fatty acid amine salts, particularly fatty acid amine salts. The method for producing these fatty acid salts is not particularly limited. For example, a fatty acid salt may be produced by heating water, adding a fatty acid, then adding triethanolamine, and carrying out heating with agitation for a certain period of time so as to effect saponification reaction. At this time, the molar ratio of the fatty acid to the triethanolamine is adjusted to the range of 1:0.5 to 1:0.9, such that the proportion of the fatty acid is higher. By doing so, the unreacted fatty acid remains after the saponification, and the fatty acid and a fatty acid amine salt can be mixed in the fixing solution. This process can also be performed by using a sodium salt or potassium salt instead.

The unsaturated fatty acid salts usable as the foaming agent are not particularly limited; however, preference is given to unsaturated fatty acid salts each having 18 carbon atoms and one to three double bonds. Specific examples thereof include oleates, linoleates and linolenates. The presence of four or more double bonds induces great reactivity, and thus the stability of the fixing solution when left to stand is inferior. These unsaturated fatty acid salts based upon unsaturated fatty acids may be used individually or in combination for the foaming agent. Also, the saturated fatty acid salts and the unsaturated fatty acid salts may be mixed together and thusly used for the foaming agent.

A liquid plasticizer has strong defoaming effects, and the foamability and foam stability of the fixing solution degrade as the concentration of the liquid plasticizer increases in the fixing solution, which makes foaming difficult and causes bubbles to break immediately. Thus, it may be impossible to obtain a foamy fixing solution with low foam density.

In an attempt to eliminate the degradation of foamability that occurs when the concentration of the liquid plasticizer in the fixing solution is increased, various samples have been produced with the types and concentrations of anionic surfactants serving as factors. As a result, it has been found that use of a fatty acid salt having 12 to 18 carbon atoms as the foaming agent and inclusion of a fatty acid having 12 to 18 carbon atoms in the fixing solution make it possible to prevent degradation of the foamability of the fixing solution even when the concentration of the liquid plasticizer is high. This makes it possible to provide a stable foamy fixing solution.

Here, regarding the foaming agent included in the fixing solution, the number of carbon atoms contained in the fatty acid salt is preferably in the range of 12 to 18 because superior foamability can be obtained in comparison with the case where merely water is foamed. Specific examples of the fatty acid salt include laurates (number of carbon atoms: 12), myristates (number of carbon atoms: 14), pentadecylates (number of carbon atoms: 15), palmitates (number of carbon atoms: 16), margarates (number of carbon atoms: 17) and stearates (number of carbon atoms: 18).

The following explains actions of the liquid plasticizer and the fatty acid used in combination with the fatty acid salt as the foaming agent. In the case where an ester compound is used as the liquid plasticizer, the ester compound has ester group(s) in its chemical structure, and the fatty acid has carbonyl group(s) in its chemical structure. It is inferred from this point that the ester group(s) of the liquid plasticizer and the carbonyl group(s) of the fatty acid exhibit an electrical action in the fixing solution, which causes a bonding action between molecules and thereby improves foamability and foam stability as properties of the fixing solution.

Regarding the C12-C18 fatty acid salts usable as the foaming agent, those which have fewer numbers of carbon atoms are superior in foamability but inferior in foam stability, whereas those which have larger numbers of carbon atoms are somewhat poor in foamability but excellent in foam stability. Accordingly, although such fatty acid salts may be used individually, it is preferable to mix a plurality of fatty acid salts which contain different numbers of carbon atoms and which belong to the C12-C18 fatty acid salts. As for the mixture ratio, it is preferred that the mixture contain a myristate (number of carbon atoms: 14) most, and smaller proportions of a laurate (number of carbon atoms: 12) and a stearate. Specific suitable examples of the mass ratio among the fatty acid salts, i.e. the mass ratio of a laurate to a myristate to a palmitate to a stearate, include the following: 0:6:3:1, 0:4:3:1, 1:5:3:1 and 1:4:4:1.

The foaming agent included in the fixing solution preferably occupies 0.1% by mass to 20% by mass, more preferably 0.5% by mass to 10% by mass, of the fixing solution. When the foaming agent occupies less than 0.1% by mass, there may be a deficiency of foamability. When the foaming agent occupies more than 20% by mass, the fixing solution increases in viscosity, and thus there may be a decrease in foamability.

When the fixing solution includes a fatty acid which contains the same number of carbon atoms as the fatty acid salt serving as the foaming agent, foamability and foam stability can be maintained even when the concentration of the liquid plasticizer is high. When the concentration of the liquid plasticizer is less than 10% by mass, there is no problem with foamability even without the inclusion of the fatty acid. However, when the concentration of the liquid plasticizer is 10% by mass or more, notably 30% by mass or more, the fatty acid salt alone hardly enables the fixing solution to foam, and thus there may be degradation of foamability. Even if there is degradation of foamability, inclusion of a fatty acid which contains the same number of carbon atoms as the fatty acid salt makes it possible to maintain foamability.

It should, however, be noted that when the fatty acid content is very high, the ratio of the fatty acid salt as the foaming agent decreases, and thus there may be degradation of foamability again. In such a case, for superior foamability, the number of moles of the fatty acid salt may be made equal to or greater than that of moles of the fatty acid, and the ratio of the fatty acid to the fatty acid salt may be set in the range of 5:5 to 1:9.

Besides the combination of a fatty acid salt and a fatty acid which contain the same number of carbon atoms, a combination of a fatty acid salt and a fatty acid which contain different numbers of carbon atoms (for example, a combination of a myristic acid amine as a fatty acid salt and stearic acid as a fatty acid, or a combination of potassium palmitate as a fatty acid salt and stearic acid as a fatty acid) may be employed as long as these different numbers are in the range of 12 to 18. When a fatty acid containing 12 to 18 carbon atoms is included in the fixing solution, there is no degradation of foamability, superior foam stability can be secured and very-low-density foaming is enabled, even if a high-concentration liquid plasticizer is included in the fixing solution.

Also, in view of prevention of degradation of foamability, other anionic surfactant (e.g. alkyl ether sulfate (AES)) may be used as the foaming agent with the inclusion of a C12-C18 fatty acid in the foaming agent.

Regarding surfactants, use of a nonionic surfactant is suitable in that the permeation of a previously applied solution to paper or a toner layer can be improved. Preferred examples of the nonionic surfactant include polyoxyethylene alkyl ethers and acetylenic surfactants. Specific preferred examples thereof as polyoxyethylene alkyl ethers include polyoxyethylene lauryl ether, polyoxyethylene alkyl (12-14) ethers (12 E.O.) and polyoxyethylene alkyl (12-14) ethers, more specifically BT-12 manufactured by Nikko Chemicals Co., Ltd., and the like. Specific preferred examples thereof as acetylenic surfactants include acetylene glycol, more specifically OLFINE 1010 and OLFINE 4051F manufactured by Nissin Chemical Industry Co., Ltd.

<Diluent>

The diluent is not particularly limited as long as it contains water. Preferred examples thereof include water, and aqueous solvents prepared by adding alcohols, etc. to water. The water is not particularly limited; however, tap water contains large amounts of impurities such as calcium ions and magnesium ions, and so preference is given to water from which these metal ions have been removed to some extent. Examples of the water include purified water such as ion-exchange water, ultrafiltered water, reverse osmosis water and distilled water; and ultrapure water.

In the case where an aqueous solvent is used as the diluent, a surfactant may be added, and it is particularly preferred that the surface tension of the fixing solution be adjusted to the range of 20 mN/m to 30 mN/m. Preferred examples of the alcohols include monohydric alcohols such as cetanol; and polyhydric alcohols such as ethylene glycol, diethylene glycol, triethylene glycol, polyethylene glycol, propylene glycol, dipropylene glycol, tripropylene glycol, 1,3-butylene glycol and glycerin. These compounds are preferred because the foam stability in the foamy fixing solution can be enhanced and bubbles can be prevented from easily breaking. Inclusion of any of the monohydric or polyhydric alcohols produces an effect of preventing curl of a medium such as paper.

It is also preferred that the diluent contain an oil component to form an O/W emulsion or a W/O emulsion, for the purpose of improving permeability and preventing curl of a medium such as paper. The oil component may be selected from a variety of materials known in the art. In the case where the diluent contains an oil component, an emulsion may be formed using a dispersant. The dispersant used to form this emulsion may be selected from a variety of materials known in the art; however, preference is given to sorbitan fatty acid esters such as sorbitan monooleate, sorbitan monostearate and sorbitan sesquioleate; and sucrose esters such as sucrose lauric acid ester and sucrose stearic acid ester.

The method for dispersing the fixing solution in the form of an emulsion, using the dispersant, is not particularly limited and may be selected from a variety of methods known in the art. Examples thereof include a method using a means of performing mechanical agitation with rotary blades, such as a homomixer or homogenizer, and a method using a means of applying vibration such as an ultrasonic homogenizer. Among these, preference is given to a method of applying strong shearing force to the plasticizer(s) in the fixing solution.

<Fine Resin Particles>

The structure and material of the fine resin particles are not particularly limited as long as they are in the form of fine particles of resin. Also, the fine resin particles may be used to form any sort of electrophotographic toner and may be fine resin particles containing conductive member(s).

Regarding the fine resin particles, toner for use in an electrophotographic process is most effectively fixed when used in combination with the fixing solution of the present invention.

In the present invention, the toner is not particularly limited as long as it contains fine resin particles. For example, the toner may include a colorant, a charge controlling agent, a binder resin and a release agent and may, if necessary, include other component(s).

The colorant is not particularly limited and may be suitably selected from dyes and pigments known in the art, according to the intended purpose.

The charge controlling agent is not particularly limited and may be suitably selected from charge controlling agents known in the art, according to the intended purpose. Examples thereof include triphenylmethane dyes, molybdic acid chelate pigments, rhodamine dyes, alkoxyamines, quaternary ammonium salts (including fluorine-modified quaternary ammonium salts), alkylamides, phosphorus, phosphorus compounds, tungsten, tungsten compounds, fluorine-based activators, metal salts of salicylic acid, and metal salts of salicylic acid derivatives. These may be used individually or in combination.

The binder resin is not particularly limited and may be suitably selected according to the intended purpose. Examples thereof include polystyrene resins, styrene-acrylic copolymers and polyester resins. Among these, polyester resins each containing an ethylene oxide group or a propylene oxide group are preferable. As the polyester resins each containing an ethylene oxide group, polyol polyester resins are particularly preferable in terms of their affinity for the fixing solution. In the case where the polyester resin used contains any of these substituents and the solid plasticizer contains a functional group which has an affinity for the substituent of the polyester resin, the interaction between the functional group and the substituent causes the solid plasticizer to enter between molecules constituting the resin of the toner. As a result, a state of a so-called polymer blend is created between the solid plasticizer and the resin, which is effective when the solid plasticizer softens or swells at least part of the fine resin particles such as toner particles.

The release agent is not particularly limited and may be suitably selected according to the intended purpose. Examples thereof include waxes such as carnauba wax and polyethylene.

The other component(s) is/are not particularly limited and may be suitably selected according to the intended purpose.

Examples thereof include an external additive, a fluidity improver, a cleaning improver, magnetic material and metal soap.

Also, the toner is preferably subjected to water-repellent treatment by firmly fixing hydrophobic fine particles such as fine particles of methyl group-containing hydrophobic silica or hydrophobic titanium oxide to surfaces of toner particles.

<Foaming>

The fixing solution of the present invention is rendered into the form of foam by the after-mentioned predetermined unit and thusly used. By rendering the fixing solution into the form of foam, a favorable balance between the surface tension of the fixing solution and an internal flow can be maintained as described with reference to FIGS. 10A and 10B, thereby making it difficult for offset to occur. Here, the surface tension of the fixing solution of the present invention is preferably in the range of 20 mN/m to 30 mN/m, as described above.

The fixing solution of the present invention in the form of foam preferably has a sufficient affinity for the toner particles subjected to the water-repellent treatment. Here, the term "affinity" means the extent of wetness of the surface of a solid caused by a liquid spreading over the surface, when the liquid has come into contact with the solid. In other words, the fixing solution in the form of foam preferably exhibits sufficient wettability to the toner subjected to the water-repellent treatment. The surface of the toner subjected to the water-repellent treatment with hydrophobic fine particles such as fine particles of hydrophobic silica or hydrophobic titanium oxide is covered with methyl groups present on the surfaces of the particles of the hydrophobic silica or the hydrophobic titanium oxide and has a surface energy of approximately 20 mN/m. In reality, though, the surface of the toner subjected to the water-repellent treatment is not entirely covered with the hydrophobic fine particles, and so the surface energy of the toner subjected to the water-repellent treatment is estimated at approximately 20 mN/m to approximately 30 mN/m. Accordingly, in order to allow the fixing solution in the form of foam to have an affinity (sufficient wettability) for the water-repellent toner, it is preferred that the surface tension of the fixing solution in the form of foam be in the range of 20 mN/m to 30 mN/m.

<Recording Medium>

The recording medium for use in the present invention is not particularly limited as long as fine resin particles which constitute toner, etc. can be fixed thereto, and the recording medium may be suitably selected according to the intended purpose. In particular, the recording medium preferably has permeability to the fixing solution. In the case where a substrate of a medium does not have liquid permeability, the medium preferably includes a liquid-permeable layer over the substrate. The form of the recording medium is not particularly limited, and the recording medium may be in the form of a three-dimensional object with flat surface(s) and/or curved surface(s) as well as in the form of a sheet. For example, the recording medium may be a medium such as paper, with transparent fine resin particles uniformly fixed to the medium so as to protect its surface (so-called varnish coat). The material for the recording medium is not particularly limited and may be suitably selected according to the intended purpose. Examples thereof include commonly used fibers for paper, cloth, etc., plastic films including liquid-permeable layers such as OHP sheets, metals, resins and ceramics.

<Other Component(s)>

<<Liquid Plasticizer>>

The fixing solution of the present invention may further include a liquid plasticizer. This liquid plasticizer is not particularly limited as long as it is soluble in the diluent and exhibits its plasticizing capability under certain conditions. For example, the liquid plasticizer may independently exhibit its plasticizing capability and soften fine resin particles (which constitute toner) by dissolving or swelling at least part of the fine resin particles; alternatively, plasticizing capability may be exhibited by combining the liquid plasticizer with the solid plasticizer. Suitable examples of the liquid plasticizer include ester compounds, since they are superior in dissolving or swelling capability under certain conditions. Among these ester compounds, aliphatic esters and carbonic acid esters are preferable in that they can superiorly soften resins or the extent of a hindrance to foamability caused by the diluent can be reduced.

In view of safety for human bodies, it is preferred that the acute oral toxicity $LD_{50}$ of the liquid plasticizer be 3 g/kg or greater, more preferably 5 g/kg or greater. The aliphatic esters are particularly preferable as the liquid plasticizer because they are highly safe for human bodies, which is evident from the fact that they are frequently used as raw materials for cosmetics.

The toner as the fine resin particles is fixed to the recording medium by a frequently used device in a sealed environment, and the liquid plasticizer remains in the toner after the toner has been fixed to the recording medium. Therefore, it is preferred that the toner be fixed to the recording medium without generating a volatile organic compound (VOC) or unpleasant smell. With regard to this point, it is preferred that the liquid plasticizer not contain any volatile organic compounds (VOCs) or materials which cause unpleasant smells. The aliphatic esters are particularly preferable in that they have high boiling points and low volatility and do not have irritating smells, in comparison with general-purpose organic solvents (e.g. toluene, xylene, methyl ethyl ketone and ethyl acetate).

As a practical measure of odor which enables measurement of odor in an office environment, etc. with high precision, the odor index [10×log (dilution rate of a substance, which makes odor of the substance impossible to sense)] in accordance with the three-point comparison type smell bag method that is a sensory measurement method may be used. Also, the odor index of an aliphatic ester contained in the liquid plasticizer is preferably 10 or less. If so, an unpleasant smell is not sensed in an ordinary office environment. Further, similarly to the liquid plasticizer, it is preferred that other liquid agents included in the fixing solution have neither unpleasant smells nor irritating smells.

—Aliphatic Ester—

The aliphatic ester is not particularly limited and may be suitably selected according to the intended purpose. For example, the aliphatic ester may be a saturated aliphatic ester, an aliphatic monocarboxylic acid ester, an aliphatic dicarboxylic acid ester or an aliphatic dicarboxylic acid dialkoxyalkyl.

—Saturated Aliphatic Ester—

In the case where the aliphatic ester is a saturated aliphatic ester, it is possible to improve the storage stability (e.g. resistance to oxidation and hydrolysis) of the liquid plasticizer. Also, the saturated aliphatic ester is highly safe for human bodies. Many saturated aliphatic esters can dissolve or swell resin contained in toner in a short period of time, e.g. within one second. Further, saturated aliphatic esters can reduce the stickiness of toner provided on recording media. It is inferred that this is because the saturated aliphatic esters form an oil film over the surface of the dissolved or swollen toner.

In the fixing solution of the present invention, the saturated aliphatic ester is preferably a compound represented by the general formula $R^1COOR^2$, where $R^1$ denotes a C11-C14 alkyl group, and $R^2$ denotes a C1-C6 straight-chain or branched alkyl group. When the numbers of carbon atoms of $R^1$ and $R^2$ are so small as to be outside these respective preferred ranges, there is generation of odor. When the numbers thereof are so large as to be outside these respective preferred ranges, there is a decrease in resin softening capability. In other words, in the case where the saturated aliphatic ester is a compound represented by the general formula $R^1COOR^2$, where $R^1$ denotes a C11-C14 alkyl group, and $R^2$ denotes a C1-C6 straight-chain or branched alkyl group, it is possible to improve dissolution or swelling of the resin contained in the toner. Also, it is preferred that the compound represented by the general formula $R^1COOR^2$ above have an odor index of 10 or less because, if so, the compound has neither an unpleasant smell nor an irritating smell.

—Aliphatic Monocarboxylic Acid Ester—

Examples of the aliphatic monocarboxylic acid ester include ethyl laurate, hexyl laurate, ethyl tridecylate, isopropyl tridecylate, ethyl myristate and isopropyl myristate. Note that many of these aliphatic monocarboxylic acid esters are soluble in oily solvents but insoluble in water. Accordingly, in the case where a fixing solution containing an aqueous solvent is prepared using an aliphatic monocarboxylic acid ester, a glycol as the after-mentioned dissolution auxiliary agent may be included in the fixing solution such that it is in a dissolved form or in the form of a microemulsion.

—Aliphatic Dicarboxylic Acid Ester—

The aliphatic ester may be an aliphatic dicarboxylic acid ester. In the case where the aliphatic ester is an aliphatic dicarboxylic acid ester, the fine resin particles contained in the toner can be dissolved or swelled in a shorter period of time. In high-speed printing at 60 ppm (pages per minute) or so, for example, the length of time in which the fixing solution is provided to unfixed toner on a recording medium and the toner is fixed to the recording medium is preferably one second or shorter. In the case where the aliphatic ester is an aliphatic dicarboxylic acid ester, the length of time in which the fixing solution is provided to unfixed toner or the like on a recording medium and the toner or the like is fixed to the recording medium can be 0.1 seconds or shorter. Further, since addition of a very small amount of the liquid plasticizer makes it possible to dissolve or swell the fine resin particles contained in the toner, the amount of the liquid plasticizer included in the fixing solution can be reduced.

In the fixing solution of the present invention, the aliphatic dicarboxylic acid ester is preferably a compound represented by the general formula $R^3(COOR^4)_2$, where $R^3$ is a C3-C8 alkylene group and $R^4$ is a C3-C5 straight-chain or branched alkyl group. When the numbers of carbon atoms contained in $R^3$ and $R^4$ are so small as to be outside these respective preferred ranges, there is generation of odor. When the numbers thereof are so large as to be outside these respective preferred ranges, there is a decrease in resin softening capability.

In the case where the aliphatic dicarboxylic acid ester is a compound represented by the general formula $R^3(COOR^4)_2$, where $R^3$ is a C3-C8 alkylene group and $R^4$ is a C3-C5 straight-chain or branched alkyl group, it is possible to improve dissolution or swelling of the fine resin particles contained in the toner. Also, it is preferred that the compound represented by the general formula $R^3(COOR^4)_2$ have an odor index of 10 or less because, if so, the compound has neither an unpleasant smell nor an irritating smell.

Examples of the aliphatic dicarboxylic acid ester include 2-ethylhexyl succinate, dibutyl adipate, diisobutyl adipate, diisopropyl adipate, diisodecyl adipate, diethyl sebacate and dibutyl sebacate. Note that many of these aliphatic dicarboxylic acid esters are soluble in oily solvents but insoluble in water. Accordingly, in the case where a fixing solution containing an aqueous solvent is prepared using an aliphatic dicarboxylic acid ester, a glycol as the after-mentioned dissolution auxiliary agent may be included in the fixing solution such that it is in a dissolved form or in the form of a microemulsion.

—Aliphatic Dicarboxylic Acid Dialkoxyalkyl—

In the fixing solution of the present invention, the aliphatic ester is preferably an aliphatic dicarboxylic acid dialkoxyalkyl. When the aliphatic ester is an aliphatic dicarboxylic acid dialkoxyalkyl, it is possible to improve fixation of the toner to the recording medium.

Regarding the liquid plasticizer optionally included in the fixing solution of the present invention, the aliphatic dicarboxylic acid dialkoxyalkyl is preferably a compound represented by the general formula $R^5(COOR^6—O—R^7)_2$, where $R^5$ is a C2-C8 alkylene group, $R^6$ is a C2-C4 alkylene group and $R^7$ is a C1-C4 alkyl group. When the numbers of carbon atoms contained in $R^5$, $R^6$ and $R^7$ are so small as to be outside these respective preferred ranges, there is generation of odor. When the numbers thereof are so large as to be outside these respective preferred ranges, there is a decrease in resin softening capability.

In the case where the aliphatic dicarboxylic acid dialkoxyalkyl is a compound represented by the general formula $R^5(COOR^6—O—R^7)_2$, where $R^5$ is a C2-C8 alkylene group, $R^6$ is a C2-C4 alkylene group and $R^7$ is a C1-C4 alkyl group, it is possible to improve dissolution or swelling of the resin contained in the toner. Also, it is preferred that the compound represented by the general formula $R^5(COOR^6—O—R^7)_2$ have an odor index of 10 or less because, if so, the compound has neither an unpleasant smell nor an irritating smell.

Examples of the aliphatic dicarboxylic acid dialkoxyalkyl include diethoxyethyl succinate, dibutoxyethyl succinate, dicarbitol succinates such as fatty acid dicarbitols, dimethoxyethyl adipate, diethoxyethyl adipate, dibutoxyethyl adipate and diethoxyethyl sebacate. In the case where any of these aliphatic dicarboxylic acid dialkoxyalkyls is used in an aqueous solvent, a glycol may if necessary be included as a dissolution auxiliary agent in the fixing solution such that it is in a dissolved form or in the form of a microemulsion.

Further, the compounds represented by General Formula (A) below, shown as compounds having structures similar to those of aliphatic dicarboxylic acid dialkoxyalkyls, have high proportions of ether groups in their molecules. Thus, the solubility of these compounds in water as the diluent is very high, so that use of any of these compounds makes it possible to produce a fixing solution including a high-concentration liquid plasticizer.

$$R^8(COO—(R^9—O)_n—R^{10})_2 \qquad \text{General Formula (A)}$$

In General Formula (A), n denotes an integer of 1 to 3, $R^8$ denotes a C2-C8 alkylene group, $R^9$ denotes a C1-C3 alkylene group and $R^{10}$ denotes a C1-C4 alkyl group.

Examples of the compounds represented by General Formula (A) above include diethoxyethoxyethyl succinate (otherwise called "dicarbitol succinate"), diethoxyethoxyethyl adipate, dimethoxyethoxyethyl succinate and dimethoxymethoxypropyl succinate.

—Carbonic Acid Ester—

The carbonic acid esters, mentioned as examples of the liquid plasticizer, include glycerol 1,2-carbonate, 4-methoxymethyl-1,3-dioxolan-2-one, cyclic esters such as ethylene carbonate and propylene carbonate, and so forth.

Examples of ester compounds other than the above-mentioned ones include citric acid esters such as triethyl citrate, triethyl acetylcitrate, tributyl citrate and tributyl acetylcitrate; compounds produced by esterifying glycols such as ethylene glycol diacetate, diethylene glycol diacetate and triethylene glycol diacetate; and compounds produced by esterifying glycerin, such as monoacetin, diacetin and triacetin.

The liquid plasticizer preferably occupies 0.5% by mass to 50% by mass, more preferably 5% by mass to 40% by mass, of the fixing solution. When the liquid plasticizer occupies less than 0.5% by mass, it may be impossible to obtain a sufficient effect of dissolving or swelling the fine resin particles contained in the toner. When the liquid plasticizer occupies more than 50% by mass, the fluidity of the resin contained in the toner cannot be reduced for a long period of time, and a fixed toner layer possibly has adhesiveness.

<<Dissolution Auxiliary Agent>>

The fixing solution of the present invention may include a dissolution auxiliary agent for the purpose of dissolving the liquid plasticizer in the fixing solution. The dissolution auxiliary agent is not particularly limited as long as it can dissolve the liquid plasticizer. Examples thereof include polyhydric alcohols. These polyhydric alcohols are exemplified by ethylene glycol, diethylene glycol, triethylene glycol, polyethylene glycol, propylene glycol, dipropylene glycol, tripropylene glycol, 1,3-butylene glycol and glycerin. Among these, propylene glycol and dipropylene glycol are preferable in that they can dissolve the liquid plasticizer even when it has a high concentration, and they do not degrade the foamability of the foaming agent. As for the amount of any of these polyhydric alcohols included in the fixing solution, it preferably occupies 1% by mass to 30% by mass of the fixing solution. When it occupies more than 30% by mass, its use may be unsuitable because there may be degradation of foamability. When it occupies less than 1% by mass, the liquid plasticizer may dissolve with difficulty in water as the diluent, as the concentration of the liquid plasticizer in the fixing solution increases.

<<Foam Booster>>

The fixing solution of the present invention is rendered into the form of foam and used as the after-mentioned foamy fixing solution for fixing the fine resin particles. If bubbles break when the foamy fixing solution is forced into a fine particle layer such as a toner layer at an application contact nip portion and thereby permeates through the layer, the permeation is hindered. Accordingly, the fixing solution of the present invention may further include a foam booster for the purpose of suppressing such a phenomenon and improving foam stability. The foam booster is not particularly limited; however, it is preferably a fatty acid alkanolamide, with the fatty acid alkanolamide (1:1) type being particularly preferable in terms of foam stability. The foam booster preferably occupies 0.01% by mass to 3% by mass of the fixing solution.

(Fixing Method and Fixing Device)

A fixing method of the present invention includes a foamy fixing solution producing step, a layer thickness adjusting step and a foamy fixing solution providing step. If necessary, the fixing method may further include other step(s).

A fixing device of the present invention includes a foamy fixing solution producing unit, a foamy fixing solution providing unit and a layer thickness adjusting unit. If necessary, the fixing device may further include other unit(s).

The fixing method of the present invention can be suitably put into practice by using the fixing device of the present invention. The foamy fixing solution producing step can be suitably performed by the foamy fixing solution producing unit, the layer thickness adjusting step can be suitably performed by the layer thickness adjusting unit, the foamy fixing solution providing step can be suitably performed by the foamy fixing solution providing unit, and the other step(s) can be suitably performed by the other unit(s).

<Foamy Fixing Solution Producing Step and Foamy Fixing Solution Producing Unit>

The foamy fixing solution producing step is a step of rendering the fixing solution of the present invention into the form of foam so as to produce a foamy fixing solution. This step can be suitably performed by the foamy fixing solution producing unit.

In the present invention, as shown in FIG. 1, by making the fixing solution a foamy fixing solution 14 (which is in the form of foam) by means of the foamy fixing solution producing unit, it is possible to lower the bulk density of the fixing solution and increase the thickness of a fixing solution layer on an applicator roller 11. Furthermore, since effects caused by the surface tension of the fixing solution can be lessened, it is possible to prevent offset of fine resin particles to the applicator roller 11.

Figure 10A:
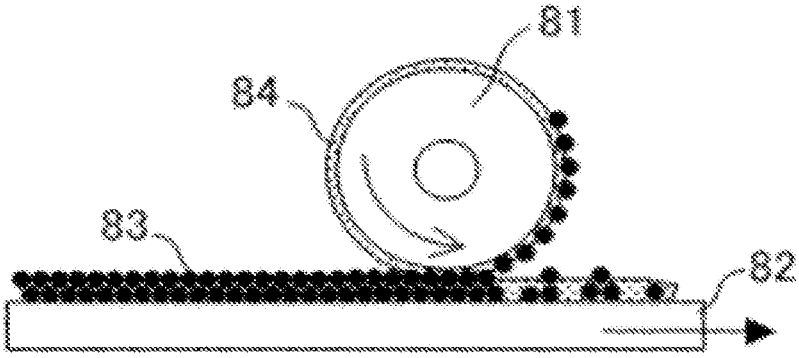
FIG. 10A is a schematic cross-sectional view showing offset arising in a conventional fixing device.
Figure 10B:
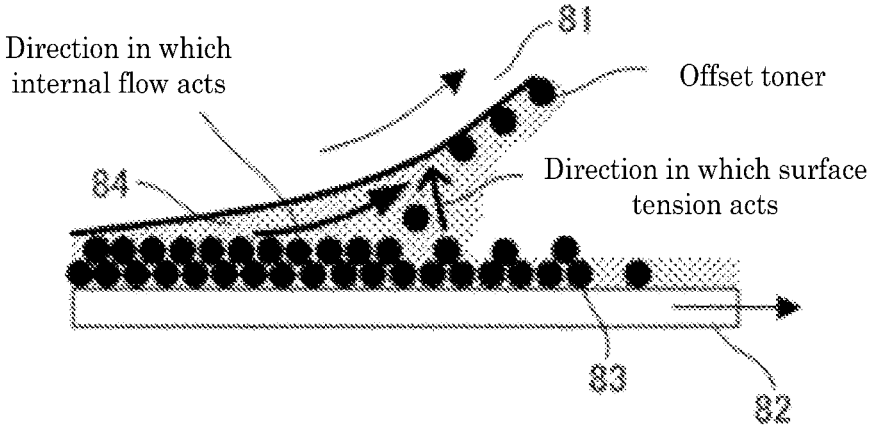
FIG. 10B is a schematic cross-sectional view showing offset arising in a conventional fixing device.

Here, an occurrence of offset in a conventional fixing device is explained referring to drawings. FIGS. 10A and 10B are schematic drawings showing an occurrence of offset in a conventional fixing device. FIG. 10B is a partially enlarged drawing of FIG. 10A. With reference to these drawings, when a fixing solution layer 84 is in liquid form, strong surface tension acts on the liquid surface of the fixing solution layer 84 formed on an applicator roller 81, along the roller surface. Also, inside the fixing solution layer on the applicator roller 81, there is an internal flow arising in the moving direction of the applicator roller. Thus, when the fixing solution layer on the applicator roller 81 is as thick as or thinner than a toner layer, surface tension acts strongly in such a manner as to pull an unfixed toner layer 83 toward the surface of the applicator roller 81, and the internal flow acts in such a manner as to convey toner along the applicator roller surface. Consequently, unfixed toner adheres or sticks to the applicator roller 81, thereby causing toner offset. When the fixing solution layer on the applicator roller 81 is two or more times thicker than the toner layer, the effects of the liquid's surface tension and the internal flow on the toner lessen. Thus, when the fixing solution layer on the applicator roller 81 is thick, there is a reduction in toner offset. In other words, uniform application of the fixing solution, which prevents offset of the fine resin particles, necessitates increasing the thickness of the fixing solution layer on the surface of the applicator roller 81 to some extent. Meanwhile, the smaller the amount of the fixing solution over a fine resin particle layer on a medium is (after its application), the greater effects can be obtained in enhancement of fixation responsiveness, reduction in the amount of residual liquid that is felt, and prevention of curl. This means that the mass of the fixing solution is preferably small. To satisfy such conditions that the fixing solution layer is thick and large in volume when the fixing solution is applied and that the mass of the fixing solution on the medium is small after applied, the density of the fixing solution should be small. Therefore, even though the volume of the fixing solution layer is large at the time of the application, the mass of the fixing solution applied can be practically reduced.

In the present invention, by employing the above-mentioned structure, offset of the fine resin particles at the time of fixation can be prevented as shown, for example, in FIG. 1.

In the fixing method and the fixing device according to the present invention, the foamy fixing solution producing step and the foamy fixing solution producing unit are not particularly limited as long as they can render the fixing solution of the present invention into the form of foam and thereby produce a foamy fixing solution. The following explains one aspect of the foamy fixing solution producing step and the foamy fixing solution producing unit, referring to FIG. 3.

Figure 3:
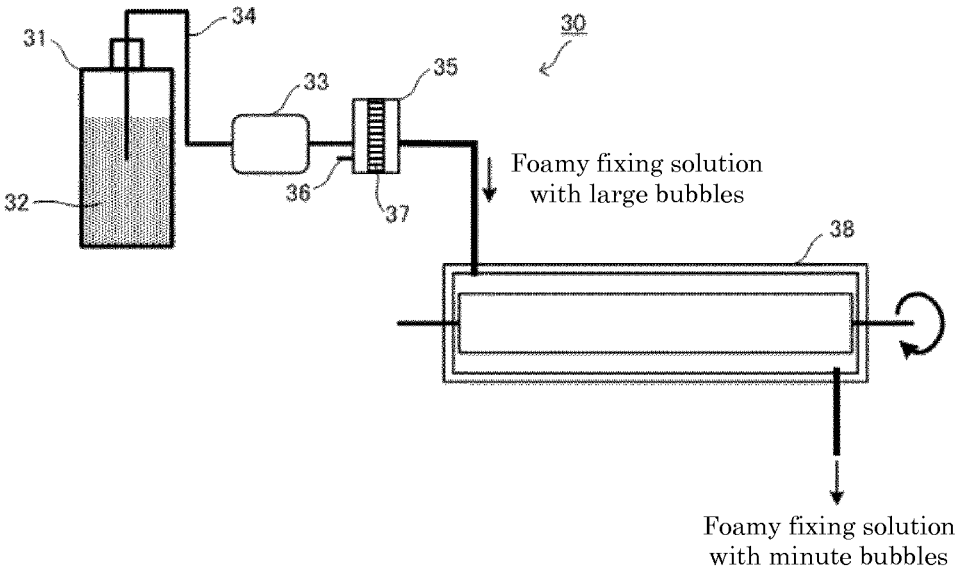
FIG. 3 is a schematic drawing showing a structure of a foamy fixing solution producing unit disposed in a fixing device of the present invention.

FIG. 3 is a schematic drawing showing a structure of a foamy fixing solution producing unit provided in the fixing device of the present invention. A foamy fixing solution producing unit 30 shown in FIG. 3 includes a fixing solution container 31 for storing a liquid fixing solution 32 exemplified by the fixing solution of the present invention, a liquid conveyance pipe 34 for conveying the liquid fixing solution 32, a conveyance pump 33 with which to obtain driving force for conveying the liquid fixing solution, a gas-liquid mixing portion 35 where gas and liquid are mixed together, and a foam producing portion 38 in which the liquid fixing solution 32 is rendered into the form of foam and a desired foamy fixing solution is thus obtained.

The liquid fixing solution 32 stored in the fixing solution container 31 is conveyed in liquid form through the liquid conveyance pipe 34 by the driving force of the conveyance pump 33 and sent to the gas-liquid mixing portion 35. The conveyance pump is not particularly limited as long as it can convey the liquid fixing solution in liquid form. Examples thereof include tube pumps, gear pumps and bellows pumps, with preference being given to tube pumps. When there is a vibratory mechanism or a rotary mechanism, such as a gear pump, the fixing solution foams inside the pump, the fixing solution is compressed, and thus there is possibly a decrease in conveyance capability. Moreover, components of the mechanism, etc. could smear the fixing solution, or conversely, the fixing solution could degrade the components of the mechanism, etc. Meanwhile, a tube pump is a mechanism which forces out the liquid in the tube while deforming the tube, so that the tube is the only member which comes into contact with the fixing solution, and therefore use of a member resistant to the fixing solution makes it possible to prevent smearing of the fixing solution and degradation of components of the pump. Also, since only the deformation of the tube takes place, the fixing solution does not foam and thus it is possible to prevent decrease in conveyance capability.

The gas-liquid mixing portion 35 is provided with an air inlet 36. As the liquid flows, negative pressure is generated at the air inlet 36, a gas is introduced from the air inlet 36 into the gas-liquid mixing portion 35, and the liquid and the gas are mixed together. Further, by passing the gas-liquid mixture through a porous sheet 37, it is possible to produce large bubbles with a uniform diameter. The pore diameter is preferably in the range of 30 μm to 100 μm. The porous sheet 37 shown in FIG. 3 does not necessarily have to be used; any porous member having a continuous air bubble structure may be used, or a sintered ceramic plate, unwoven cloth or foamed resin sheet (each of which has a pore diameter of 30 μm to 100 μm) may also be used. Other preferred methods for producing large bubbles include a method in which the liquid fixing solution supplied from the conveyance pump and air introduced from the air inlet are stirred with a blade-like stirrer, which allows air bubbles to be mixed with the liquid, and large bubbles are thus produced, and a method in which bubbling is carried out on the liquid fixing solution supplied from the conveyance pump, using an air supply pump or the like, so as to produce large bubbles.

Next, the liquid fixing solution 32 mixed with the air is sent to the foam producing portion 38 where a desired foamy fixing solution is obtained. In the foam producing portion 38, shearing force is applied to the liquid fixing solution 32 mixed with the air, and each large bubble is divided into two or more bubbles. The structure of the foam producing portion 38 is not particularly limited as long as this sort of process is carried out. For example, the following structure may be employed: there are closed double cylinders, with the inner cylinder being rotatable, a fixing solution in the form of large bubbles is supplied from a part of the outer cylinder, and the fixing solution receives shearing force produced by the rotating inner cylinder while passing through the gap (which serves as a flow path) between the outer cylinder and the rotating inner cylinder. Large bubbles are changed to minute bubbles by this shearing force, and a foamy fixing solution having a desired minute bubble diameter can be obtained from a foam outlet provided in the outer cylinder. Additionally, solution conveyance capability may be increased inside the cylinder by providing spiral grooves in the inner cylinder.

The fixing solution is satisfactory as long as it is in the form of foam when applied to a fine resin particle layer such as a toner layer on a medium such as paper. Therefore, the fixing solution does not need to be in the form of foam inside the fixing solution container. A structure is preferred in which the fixing solution is a liquid without air bubbles inside the fixing solution container and it is rendered into the form of foam by a certain unit when supplied from the container, or when passing through a solution conveyance path before provided to the fine resin particle layer. This is because a great advantage, i.e. a reduction in the size of the container, can be achieved by employing the structure wherein the fixing solution is liquid in the fixing solution container and is rendered into the form of foam after taken out of the container.

The fixing solution of the present invention is rendered into the form of foam, and the thickness of a foamy fixing solution layer formed of the foamy fixing solution is adjusted in the after-mentioned manner at the surface of the foamy fixing solution providing unit in relation to the entire surface of a recording medium, according to the thickness of a fine resin particle layer fixed. For instance, in the case where the fine resin particles constitute toner, and color images and black-and-white letters/characters are present in a mixed manner on the recording medium, there may be the following partial defects if a foamy fixing solution layer having a uniform thickness is provided over the entire surface of the recording medium: fixation failure and/or absence of parts of images may happen to thick toner layers such as color photographic images, and printed objects may adhere to each other because of stickiness generated on the black-and-white letters/characters.

Generally, in the case of large bubbles which are approximately 0.5 mm to approximately 1 mm in diameter, they can be relatively easily produced by simple agitation or the like. Such large bubbles can be produced within a few seconds (perhaps in less than 0.1 seconds). As a result of taking note of the fact that bubbles (having diameters greater than a desired diameter and having sizes which allow the bubbles to be visually observed) can be easily produced and quickly obtained, and earnestly examining a method for quickly producing minute bubbles (of approximately 5 μm to approximately 50 μm in diameter) from large bubbles, the following has been found: when large bubbles are divided by application of shearing force to the large bubbles, minute bubbles of a desired size can be produced very quickly in comparison with the method of producing minute bubbles from a liquid state. It should be noted that the structure of the foamy fixing solution producing unit 30 is suitable for realizing the foregoing.

By thusly combining a large bubble producing portion (where the liquid fixing solution is changed to a solution with a large bubble diameter) and a minute bubble producing portion (where shearing force is applied to large bubbles so as to produce minute bubbles), it is possible to produce in a very short period of time a foamy fixing solution having a minute bubble diameter of 5 μm to 50 μm from the liquid fixing solution.

Figure 2:
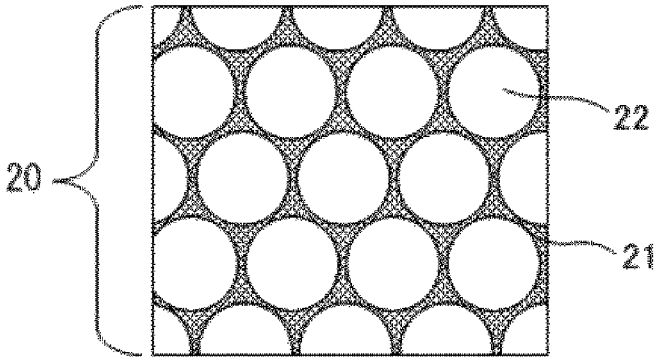
FIG. 2 is a schematic cross-sectional view showing a structure of a foamy fixing solution.

Especially in the case where the fine resin particles have an average particle diameter of approximately 5 μm to approximately 10 μm, the foamy fixing solution 14 preferably ranges from 5 μm to 50 μm in bubble diameter if the foamy fixing solution 14 is to be provided to a fine resin particle layer 13 on a recording medium 12 without disturbing the fine resin particle layer 13. Parenthetically, as shown in FIG. 2, a foamy fixing solution 20 formed with air bubbles 22 also includes liquid film boundaries 21 which separate the air bubbles 22 from one another.

<Layer Thickness Adjusting Step and Layer Thickness Adjusting Unit>

The layer thickness adjusting step is a step of adjusting the thickness of a layer of the foamy fixing solution such that the layer having a desired thickness forms on a contact surface of the foamy fixing solution providing unit. This step can be suitably performed by the layer thickness adjusting unit.

The layer thickness adjusting unit is not particularly limited as long as a layer of the foamy fixing solution having a desired thickness can be formed on the contact surface of the foamy fixing solution providing unit, and the layer thickness adjusting unit may be suitably selected according to the intended purpose. Examples thereof include a layer thickness adjusting blade, and a combination of a blade and an applicator roller. An aspect of the layer thickness adjusting step and the layer thickness adjusting unit will be later described.

<Foamy Fixing Solution Providing Step and Foamy Fixing Solution Providing Unit>

The foamy fixing solution providing step is a step of providing the formed layer of the foamy fixing solution having the desired thickness to a fine resin particle layer on a medium. This step can be suitably performed by the foamy fixing solution providing unit.

Figure 4A:
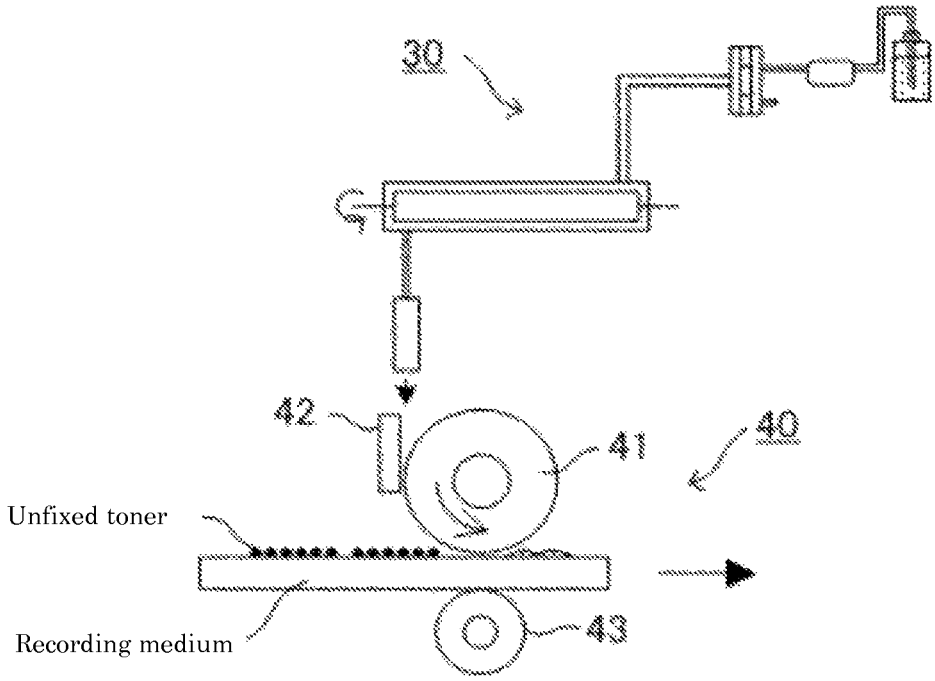
FIG. 4A is a schematic structural drawing exemplarily showing a layer thickness adjusting unit and a foamy fixing solution providing unit disposed in a fixing device of the present invention.
Figure 4B:
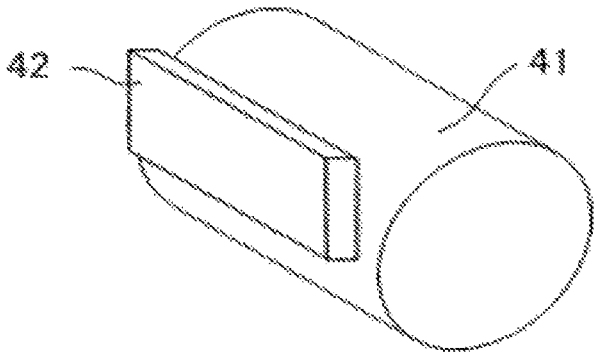
FIG. 4B is a schematic structural drawing exemplarily showing a layer thickness adjusting unit and a foamy fixing solution providing unit disposed in a fixing device of the present invention.

FIGS. 4A and 4B are schematic structural drawings exemplary showing a layer thickness adjusting unit and a foamy fixing solution providing unit in the fixing device of the present invention. A fixing device 40 according to the present invention, shown in FIG. 4A, includes an applicator roller 41 for providing the foamy fixing solution with desired minute bubbles, produced by the foamy fixing solution producing unit 30, to a fine resin particle layer (toner particle layer) formed of fine resin particles constituting toner or the like; a layer thickness adjusting blade 42 as a layer thickness adjusting unit which adjusts the thickness of a layer of the foamy fixing solution (with the desired minute bubbles) on the applicator roller surface according to the thickness of an unfixed toner layer on a recording medium and which thereby adjusts the thickness of the layer of the foamy fixing solution in an optimized manner; and a pressurizing roller 43 positioned in such a manner as to face the applicator roller 41. A recording medium with unfixed toner (which contains fine resin particles) on its surface passes through a nip portion formed by the applicator roller 41 and the pressurizing roller 43. The thickness of a layer of the foamy fixing solution produced by the foamy fixing solution producing unit 30 is adjusted by the layer thickness adjusting blade 42, and a layer of the foamy fixing solution having a desired thickness is thereby placed on the applicator roller 41. The foamy fixing solution layer thus formed on the applicator roller 41 is provided onto the unfixed toner in synchronization with the passage of the recording medium (with the unfixed toner) through the nip portion.

FIG. 4B is a schematic drawing showing the applicator roller 41 and the layer thickness adjusting blade 42 in an enlarged manner. A layer of the foamy fixing solution is formed on the applicator roller 41 (which constitutes the foamy fixing solution providing unit) using the layer thickness adjusting blade 42 (which is the layer thickness adjusting unit) according to the thickness of an unfixed toner layer on a recording medium. By means of the layer thickness adjusting blade 42, the thickness of the layer of the foamy fixing solution is optimized in relation to the air bubble size and foam viscosity of the foamy fixing solution, the pressurizing force for application, and the length of time during which the foamy fixing solution permeates through the unfixed toner layer (which is connected with the thickness of the unfixed toner layer). As described above, the foamy fixing solution with desired minute bubbles is produced by the foamy fixing solution producing unit 30 which includes the large bubble producing portion (where large bubbles are produced) and the minute bubble producing portion (where the large bubbles are divided by shearing force so as to produce minute bubbles). Then the foamy fixing solution is then applied dropwise from a solution supply port in such a manner as to pass between the applicator roller 41 and the layer thickness adjusting blade 42 as the layer thickness adjusting unit.

Figure 5A:
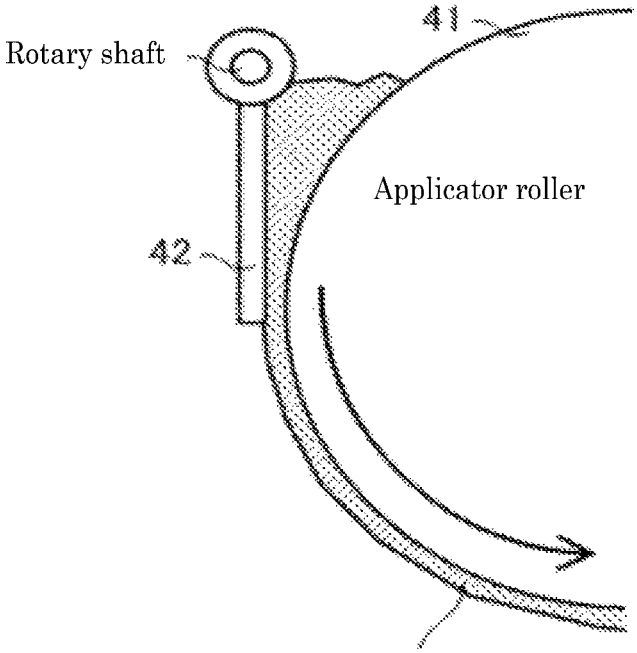
FIG. 5A is a schematic drawing showing how the thickness of a layer of a foamy fixing solution on an applicator roller is adjusted using a layer thickness adjusting blade.
Figure 5B:
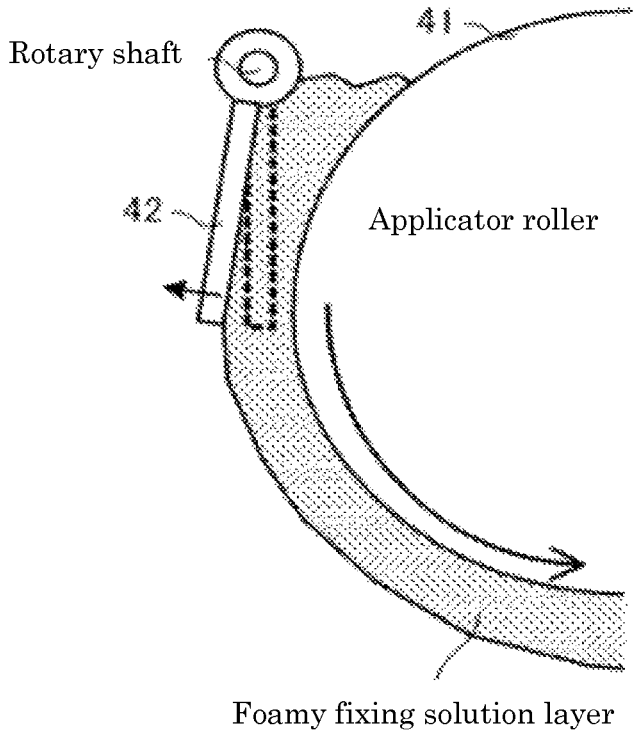
FIG. 5B is a schematic drawing showing how the thickness of a layer of a foamy fixing solution on an applicator roller is adjusted using a layer thickness adjusting blade.

As shown in FIGS. 5A and 5B, the thickness of the layer of the foamy fixing solution on the applicator roller is adjusted using the layer thickness adjusting blade 42, with a gap being formed between the applicator roller 41 and the layer thickness adjusting blade 42. When the layer thickness is reduced as shown in FIG. 5A, the gap may be narrowed. When the layer thickness is increased as shown in FIG. 5B, the gap may be broadened. The gap is adjusted using a drivable rotary shaft provided at an end of the layer thickness adjusting blade 42. The thickness of the layer of the foamy fixing solution may be adjusted in an optimized manner, for example in relation to the thickness of a toner layer, the environmental temperature, the air bubble size and foam viscosity of the foamy fixing solution, the pressurizing force for application, and the length of time during which the foamy fixing solution permeates through an unfixed toner layer (which is connected with the thickness of the unfixed toner layer).

The shape, structure, size and material of the applicator roller constituting the foamy fixing solution providing unit are not particularly limited as long as it can provide the foamy fixing solution; however, the applicator roller preferably has a curved portion at least on a part of its surface.

The layer thickness adjusting blade may be a wire bar as well as the layer thickness adjusting blade shown in FIGS. 5A and 5B. The thickness of the layer of the foamy fixing solution on the applicator roller may be adjusted using a wire bar, and the foamy fixing solution is produced, as described above, by the foamy fixing solution producing unit which includes the large bubble producing portion (where large bubbles are produced) and the minute bubble producing portion (where the large bubbles are divided by shearing force so as to produce minute bubbles). The foamy fixing solution is then applied dropwise from the solution supply port in such a manner as to pass between the layer thickness adjusting wire bar and the applicator roller. By using the wire bar as the layer thickness adjusting unit, the uniformity of the layer of the foamy fixing solution on the applicator roller surface with respect to the shaft direction improves more than in the case where a blade is used.

The bulk density of the foamy fixing solution is preferably in the range of approximately 0.01 g/cm$^3$ to approximately 0.1 g/cm$^3$. To make it impossible for residual liquid to be felt on the recording medium surface when the fixing solution has been attached thereto, the bulk density is preferably in the range of 0.01 g/cm$^3$ to 0.02 g/cm$^3$. The foam layer of the fixing solution on the contact surface of the providing unit such as the applicator roller 41 shown in FIGS. 4A and 4B must be thicker than a fine particle layer on the recording medium (in order to fill gaps in the fine particle layer with the foamy fixing solution), and the foam layer thickness is preferably in the range of 50 μm to 80 μm. To make it impossible for residual liquid (wetness) to be felt on the recording medium surface when the fixing solution has been attached thereto, the amount of the fixing solution attached per unit area of the recording medium is preferably 0.1 $mg/cm^2$ or less. Thus, the bulk density of the foamy fixing solution is particularly preferably in the range of 0.0125 $g/cm^3$ to 0.02 $g/cm^3$.

Figure 6:
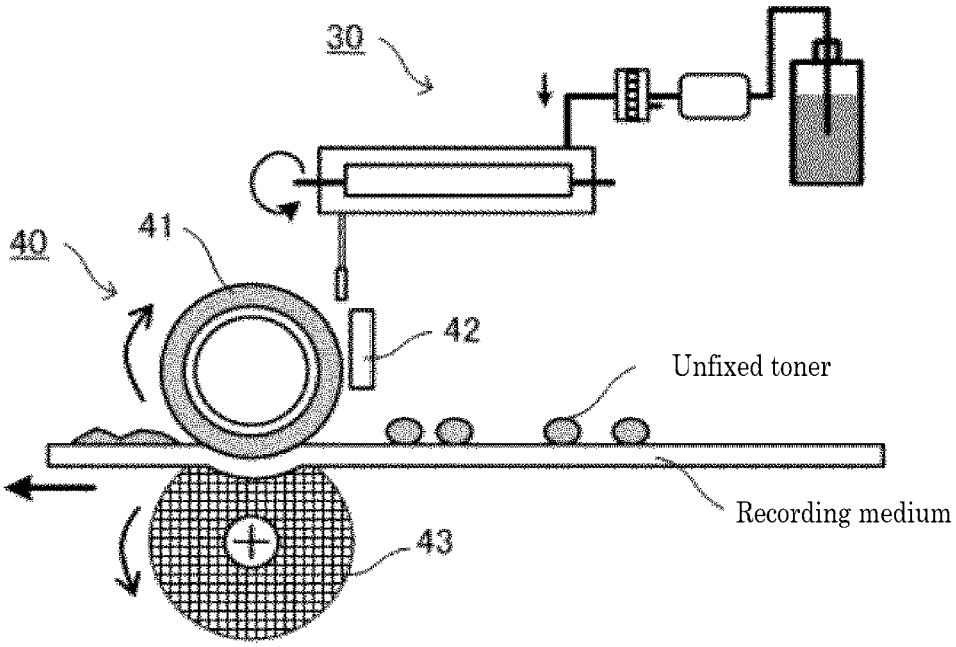
FIG. 6 is a schematic structural drawing showing a structure of a fixing device according to an embodiment of the present invention.

FIG. 6 is a schematic structural drawing showing a structure of a fixing device according to an embodiment of the present invention. In a fixing device 40 according to the embodiment shown in FIG. 6, a pressurizing roller 43 may include a resilient porous member (hereinafter referred to also as "sponge material") as a resilient layer. It is necessary for the nipping to be timed so that an applicator roller and a fine resin particle layer (such as a toner layer) separate from each other after the foamy fixing solution has permeated through the fine resin particle layer and reached a recording medium such as paper. With regard to this point, the pressurizing roller 43 including the sponge material is preferable because it makes it possible to keep the nipping time in the range of 50 milliseconds to 300 milliseconds and can greatly deform with weak pressurizing force.

Here, the nipping time can be calculated by means of the following equation: Nipping time=Nip width/Conveyance speed of paper. The conveyance speed of paper can be calculated from data on the design of a paper conveyance drive mechanism. The nip width can be calculated as follows: colored paint which does not dry is thinly applied to the entire surface of the applicator roller, the recording medium is sandwiched between the applicator roller 41 and the pressurizing roller 43 (which faces the applicator roller 41) and then pressurized (without allowing these rollers to rotate), the colored paint is attached to the recording medium, and finally the length of a colored portion (generally in the shape of a rectangle) on the recording medium with respect to the paper conveyance direction is measured as the nip width.

It is necessary to make the nipping time equal to or longer than the length of time during which the foamy fixing solution permeates through the toner layer, by adjusting the nip width according to the conveyance speed of the recording medium. In the embodiment shown in FIG. 6, the use of the sponge material as the resilient layer of the pressurizing roller 43 makes it easier to change the distance between the shafts of the applicator roller 41 and the pressurizing roller 43 and thereby change the nip width, according to the conveyance speed of the recording medium. Instead of the sponge material, resilient rubber may be used for the pressurizing roller 43. Nevertheless, the sponge material is preferable in that it can be deformed with a force weaker than the force with which the resilient rubber can be deformed, and a large nip width can be secured without making the pressurizing force of the applicator roller 41 excessively high.

In the fixing solution, the liquid plasticizer may be included, so that if the fixing solution is attached to the pressurizing roller including the sponge material, a defect could arise such as softening of the sponge material. Accordingly, the sponge material preferably includes a resin material which does not soften or swell in the presence of the liquid plasticizer. Additionally, the pressurizing roller including the sponge material may be covered with a flexible film. If the sponge material is a material which is degraded by the liquid plasticizer, degradation of the pressurizing roller can be prevented by covering the sponge material with a flexible film which does not soften or swell in the presence of the liquid plasticizer. The sponge material is not particularly limited. Examples thereof include porous objects of resins such as polyethylene, polypropylene and polyamides. The flexible film which covers the sponge material is not particularly limited as long as it exhibits flexibility. Examples thereof include films of polyethylene terephthalate, polyethylene, polypropylene and tetrafluoroethylene-perfluoroalkyl vinylether copolymers (PFA).

In FIG. 6, if the applicator roller 41 and the pressurizing roller 43 including the sponge material are always in contact with each other, the foamy fixing solution on the applicator roller 41 could possibly be attached to and smear the pressurizing roller 43 when a recording medium is not conveyed. To prevent this, it is preferred that a medium front end detecting unit (not shown) be provided somewhere upstream with respect to the recording medium conveyance direction as seen from the applicator roller 41, and that the foamy fixing solution be formed on the applicator roller 41 with a timing which enables the foamy fixing solution to be applied only to an area behind the front end of a recording medium in response to a medium front end detection signal.

Regarding the fixing device 40 shown in FIG. 6, it is also preferred that the applicator roller 41 and the pressurizing roller 43 including the sponge material be set away from each other while the fixing device 40 is on standby, and that the applicator roller 41 and the pressurizing roller 43 be brought into contact with each other by a drive mechanism (not shown) only at the time of application, in response to a signal from the medium front end detecting unit. Regarding the fixing device 40 shown in FIG. 6, it is also preferred that the rear end of a recording medium be detected as well and the applicator roller 41 and the pressurizing roller 43 including the sponge material be separated from each other in response to a medium rear end detection signal.

Figure 7:
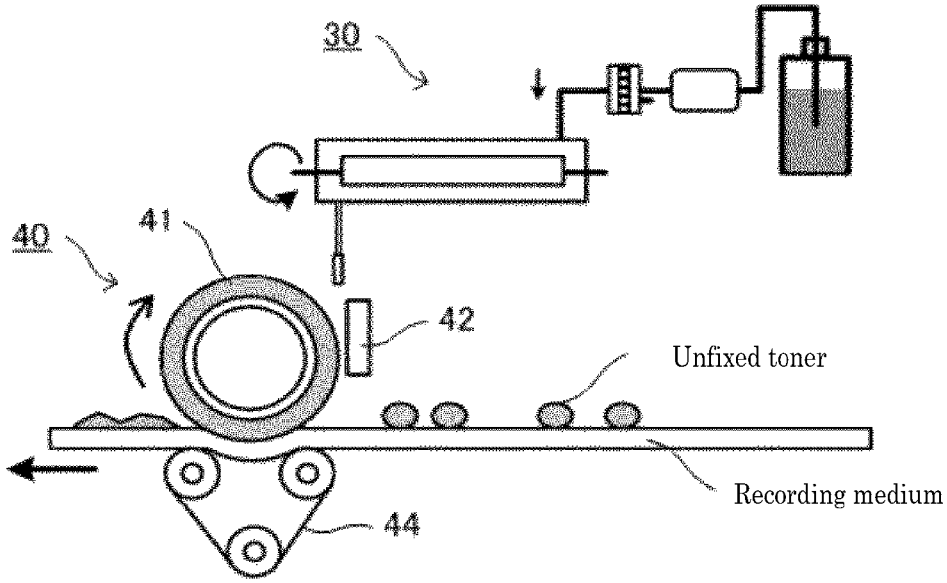
FIG. 7 is a schematic structural drawing showing another structure of a fixing device according to an embodiment of the present invention.

FIG. 7 is a schematic structural drawing showing another structure of a fixing device according to an embodiment of the present invention. A fixing device 40 shown in FIG. 7 uses a pressurizing belt 44 instead of the pressurizing roller 43 shown in FIG. 6. The foamy fixing solution with a desired bubble diameter is produced by a foamy fixing solution producing unit 30 which includes a large bubble producing portion (where large bubbles are produced) and a minute bubble producing portion (where the large bubbles are divided by shearing force so as to produce minute bubbles), and the foamy fixing solution is supplied from a solution supply port to a supply port of a layer thickness adjusting blade 42 (which is the layer thickness adjusting unit) using a tube or the like. Then the foamy fixing solution is made to have an optimized layer thickness by adjusting the gap between the layer thickness adjusting blade 42 and an applicator roller 41 and thereby adjusting the thickness of a layer of the foamy fixing solution on the applicator roller 41. The material for the pressurizing belt 44 may, for example, be a member made by coating a base object, such as a seamless nickel belt or seamless PET file, with a separable fluorine resin such as PFA.

When a belt is used as just described, it is possible to widen the nip width with ease. The structure shown in FIG. 7 does not necessarily have to be employed; for example, the applicator roller may be changed to a belt, and the pressurizing unit may be changed from the belt to a roller. Also, use of belt(s) on at least one of the application side and the pressurization side makes it possible to widen the nip width with ease and avoid application of such an excessive force as causes creases in paper. Further, when the nipping time and the paper conveyance speed are linked, it is possible to increase the paper conveyance speed and thus to enable high-speed fixation.

The toner fixing device may include a pair of smoothing rollers (hard rollers) which (after the fixing solution of the present invention has been supplied to toner) pressurizes the toner, at least part of which has softened or swelled. By pressurizing the toner, at least part of which has softened or swelled, with the pair of smoothing rollers (hard rollers), it is possible to smooth the surface of a layer of the toner and give the toner a gloss. Further, by forcing the toner (at least part of which has softened or swelled) into a recording medium, it is possible to improve fixation of the toner to the recording medium.

<Other Step(s) and Other Unit(s)>

<<Warming Step and Warming Unit>>

The fixing method and the fixing device according to the present invention may further include a warming step and a warming unit respectively, whereby the fine resin particle layer provided with the foamy fixing solution is warmed. The warming temperature in the warming step and the warming unit is not particularly limited as long as sufficient fixing properties can be obtained; however, the warming temperature is preferably in the range of 50° C. to 100° C. When the warming temperature is lower than 50° C., there may be a deficiency of fixation. When the warming temperature is higher than 100° C., it is uneconomical in terms of energy consumption.

Figure 8:
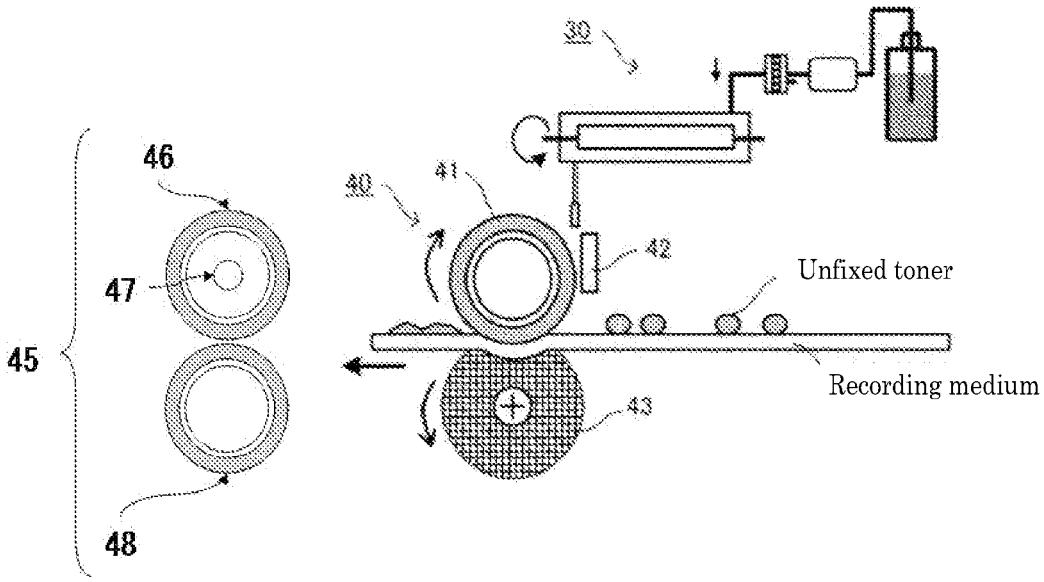
FIG. 8 is a schematic structural drawing showing yet another structure of a fixing device according to an embodiment of the present invention.

The form of the warming unit may be suitably selected as long as the above-mentioned aspect can be put into practice. For example, the warming unit may be in the form of a roller. In the case where the warming unit is formed of roller(s), the warming unit may, for example, include a pressurizing roller 46 and a pressurizing roller 48, with a warming medium such as an infrared heater 47 being provided in the roller which comes into contact with matter to be fixed, as shown in FIG. 8.

(Image Forming Method and Image Forming Apparatus)

An image forming method of the present invention includes a latent electrostatic image forming step, a developing step, a transfer step and a fixing step. If necessary, the image forming method may further include other step(s) suitably selected according to the intended purpose, such as a charge eliminating step, a cleaning step, a recycling step, a control step, etc.

An image forming apparatus of the present invention includes a latent electrostatic image bearing member, a latent electrostatic image forming unit, a developing unit, a transfer unit and a fixing unit. If necessary, the image forming apparatus may further include other unit(s) suitably selected according to the intended purpose, such as a charge eliminating unit, a cleaning unit, a recycling unit, a control unit, etc.

The image forming method of the present invention can be suitably put into practice by using the image forming apparatus of the present invention. The latent electrostatic image forming step can be suitably performed by the latent electrostatic image forming unit, the developing step can be suitably performed by the developing unit, the transfer step can be suitably performed by the transfer unit, the fixing step can be suitably performed by the fixing unit, and the other step(s) can be suitably performed by the other unit(s).

<Latent Electrostatic Image Forming Step>

The latent electrostatic image forming step is a step of forming a latent electrostatic image on a latent electrostatic image bearing member. The material, shape, structure, size and the like of the latent electrostatic image bearing member (hereinafter referred to also as "photoconductor drum", "photoconductor" or "image bearing member") are not particularly limited and may be suitably selected from those known in the art. Suitable examples of the shape include drum-like shapes. As for the material, the photoconductor may, for example, be an inorganic photoconductor including amorphous silicon, selenium, etc. or an organic photoconductor including polysilane, phthalopolymethine, etc. Among these materials, amorphous silicon and the like are preferable in that the lifetime of the photoconductor is long.

The latent electrostatic image can be formed, for example by uniformly charging the surface of the latent electrostatic image bearing member and then exposing the surface imagewise, which can be suitably performed by the latent electrostatic image forming unit. For example, the latent electrostatic image forming unit includes at least a charging device configured to charge the surface of the image bearing member uniformly, and an exposing device configured to expose the surface of the image bearing member imagewise.

The charging can be performed, for example by applying voltage to the surface of the latent electrostatic image bearing member, using a charging device. The charging device is not particularly limited and may be suitably selected according to the intended purpose. Preferred examples thereof include known contact-type charging devices provided with conductive or semiconductive rolls, brushes, films, rubber blades, etc. and non-contact-type charging devices utilizing corona discharge, such as corotron chargers and scorotron chargers.

The exposure can be performed, for example by exposing the surface of the latent electrostatic image bearing member imagewise, using an exposing device. The exposing device is not particularly limited as long as it can expose, in the intended imagewise manner, the surface of the image bearing member charged by the charging device, and the exposing device may be suitably selected according to the intended purpose. Preferred examples thereof include exposing devices which employ a copying optical system, a rod lens array system, a laser optical system, a liquid crystal shutter optical system, etc. Parenthetically, in the present invention, a backlighting method may be employed in which imagewise exposure is performed from the back surface side of the image bearing member.

<Developing Step and Developing Unit>

The developing step is a step of developing the latent electrostatic image, formed on the latent electrostatic image bearing member, with the use of a developer including a toner so as to form a visible image. The visible image can be formed, for example by developing the latent electrostatic image with the use of a developer including a toner, which can be suitably performed by the developing unit.

The developing unit is not particularly limited as long as it can develop the latent electrostatic image with the use of a toner, and it may be suitably selected from developing units known in the art. Preferred examples thereof include a developing unit incorporating at least a developing device which houses a developer including a toner and which is capable of providing the developer including the toner to the latent electrostatic image in a contact or non-contact manner. In particular, preference is given to a developing unit incorporating at least a developing device provided with a container which houses a developer including a toner.

The developing device may be of dry developing type or of wet developing type and may be a developing device for a single color or a developing device for multiple colors. Suitable examples thereof include a developing device incorporating an agitator for agitating the toner with friction and thus charging it, and also incorporating a rotatable magnet roller.

In the developing device, for example, the toner and a carrier are mixed and agitated, the toner is charged by the friction generated upon the mixing and agitation, and toner particles are held in an upright position on the surface of the rotating magnet roller, thereby forming a magnetic brush. Since the magnet roller is placed in the vicinity of the latent electrostatic image bearing member (photoconductor), part of the toner constituting the magnetic brush formed on the surface of the magnet roller moves to the surface of the latent electrostatic image bearing member (photoconductor) by electrical suction. As a result, the latent electrostatic image is developed with the toner, and a visible image made of the toner is formed on the surface of the latent electrostatic image bearing member (photoconductor).

<Transfer Step and Transfer Unit>

The transfer step is a step of transferring the visible image to a recording medium. The transfer step is not particularly limited; however, a preferred aspect of the transfer step is such that an intermediate transfer member is used, a visible image is primarily transferred onto the intermediate transfer member and then this visible image is secondarily transferred onto a recording medium. A more preferred aspect of the transfer step is such that toners of two or more colors, preferably full-color toners, are used, and there are provided a primary transfer step of transferring visible images onto an intermediate transfer member so as to form a compound transfer image thereon, and a secondary transfer step of transferring this compound transfer image onto a recording medium.

The transfer can be performed, for example by charging the latent electrostatic image bearing member (photoconductor), using a transfer charging device, which can be suitably performed by the transfer unit. A preferred aspect of the transfer unit is such that there are provided a primary transfer unit configured to transfer visible images onto an intermediate transfer member so as to form a compound transfer image thereon, and a secondary transfer unit configured to transfer this compound transfer image onto a recording medium.

The intermediate transfer member is not particularly limited and may be suitably selected from transfer members known in the art, according to the intended purpose. Suitable examples thereof include transfer belts.

The transfer unit (primary transfer unit and secondary transfer unit) preferably includes at least a transfer device for charging and thus separating the visible image formed on the latent electrostatic image bearing member (photoconductor) toward the recording medium side. Regarding the transfer unit(s), one transfer unit, or two or more transfer units may be provided.

Examples of the transfer device include corona transfer devices utilizing corona discharge, transfer belts, transfer rollers, pressure transfer rollers and adhesion transfer devices.

The recording medium is not particularly limited and may be suitably selected from recording media (recording papers) known in the art. Note that the examples of recording media explained above in relation to the fixing solution of the present invention may be used as well.

<Fixing Step and Fixing Unit>

The fixing step is a step of fixing the transferred image to the recording medium, which may be performed by the fixing method of the present invention.

The fixing unit is a unit configured to fix the transferred image to the recording medium, which may be performed using the fixing device of the present invention.

<Other Step(s) and Other Unit(s)>

<<Charge Eliminating Step and Charge Eliminating Unit>>

The charge eliminating step is a step of eliminating charge by applying a charge eliminating bias to the latent electrostatic image bearing member, which can be suitably performed by the charge eliminating unit.

The charge eliminating unit is not particularly limited as long as it can apply a charge eliminating bias to the latent electrostatic image bearing member, and it may be suitably selected from charge eliminating devices known in the art. Suitable examples thereof include charge eliminating lamps.

<<Cleaning Step and Cleaning Unit>>

The cleaning step is a step of removing the toner remaining on the latent electrostatic image bearing member, which can be suitably performed by the cleaning unit.

The cleaning unit is not particularly limited as long as it can remove the toner remaining on the latent electrostatic image bearing member, and it may be suitably selected from cleaners known in the art. Suitable examples thereof include magnetic brush cleaners, electrostatic brush cleaners, magnetic roller cleaners, blade cleaners, brush cleaners and web cleaners.

<<Recycling Step and Recycling Unit>>

The recycling step is a step of returning the toner removed by the cleaning step to the developing unit, which can be suitably performed by the recycling unit.

The recycling unit is not particularly limited. Examples thereof include conveyance units known in the art.

<<Control Step and Control Unit>>

The control step is a step of controlling the above-mentioned steps of the image forming method of the present invention, which can be suitably performed by the control unit.

The control unit is not particularly limited as long as it can control operations of the above-mentioned units of the image forming apparatus of the present invention, and it may be suitably selected according to the intended purpose. Examples thereof include apparatuses such as sequencers and computers.

An image made of a toner which contains fine resin particles may be formed on a recording medium, using the image forming method of the present invention. Therefore, according to this embodiment of the image forming apparatus of the present invention, it is possible to provide an image forming method and an image forming apparatus which are capable of fixing a toner to a recording medium further efficiently, as described above.

Figure 9A:
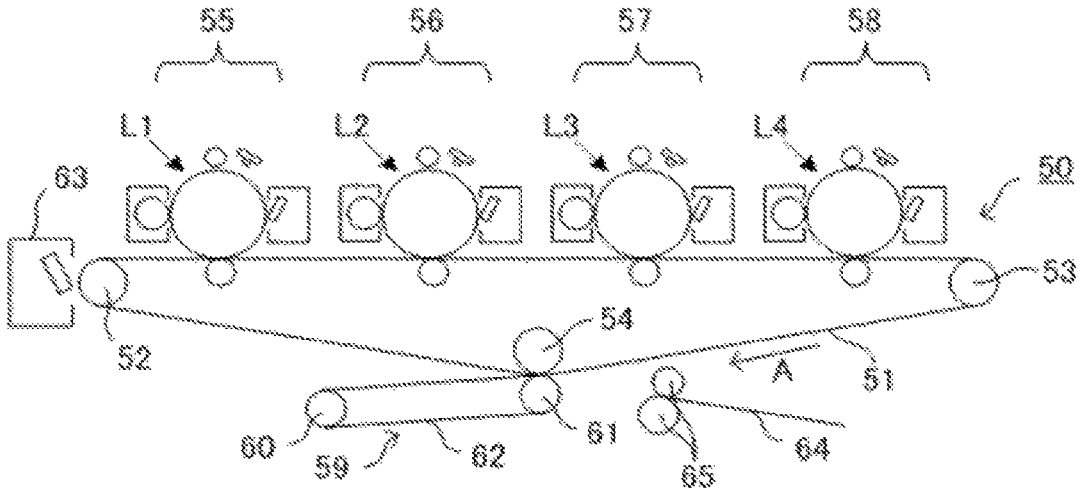
FIG. 9A is a schematic drawing exemplarily showing a structure of an image forming apparatus of the present invention.
Figure 9B:
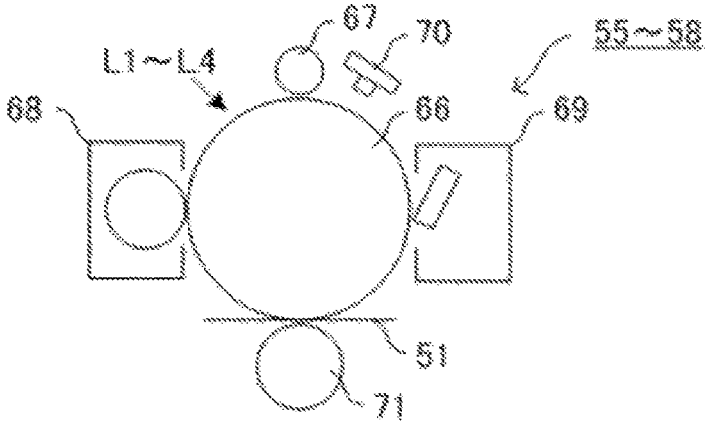
FIG. 9B is a schematic drawing exemplarily showing a structure of an image forming apparatus of the present invention.

FIGS. 9A and 9B are schematic drawings showing structures of an image forming apparatus of the present invention. Specifically, FIG. 9A is a schematic drawing showing the overall structure of a color electrophotographic tandem-type image forming apparatus, and FIG. 9B is a drawing showing the structure of one image forming unit in the image forming apparatus shown in FIG. 9A. An image forming apparatus 50 shown in FIGS. 9A and 9B may be a copier or a printer.

The image forming apparatus 50 shown in FIGS. 9A and 9B includes an intermediate transfer belt 51 as a toner image bearing member. Supported by three supporting rollers 52 to 54, the intermediate transfer belt 51 rotates in the direction of the arrow A in the drawing. Image forming units 55 to 58 for black, yellow, magenta and cyan respectively are aligned in such a manner as to face the intermediate transfer belt 51. Above these image forming units, exposing devices (not shown) are disposed. In the case where the image forming apparatus is a copier, for example, image information of a manuscript is read by a scanner, and lights L1 to L4 for forming latent electrostatic images on respective photoconductor drums are applied by the exposing devices according to this image information. A secondary transfer device 59 is provided, positioned in such a manner as to face the supporting roller 54, with the intermediate transfer belt 51 being sandwiched in between. The secondary transfer device 59 includes a secondary transfer belt 62 supported by two supporting rollers 60 and 61. For the secondary transfer device 59, a transfer roller may be used as well as the transfer belt. A belt cleaning device 63 is placed, positioned in such a manner as to face the supporting roller 52, with the intermediate transfer belt 51 being sandwiched in between. The belt cleaning device 63 is placed in order to remove toner remaining on the intermediate transfer belt 51.

Recording paper 64 as a recording medium is led to a secondary transfer portion by a pair of paper feed rollers 65. At the time of transfer of a toner image to the recording paper 64, the toner image is transferred by pressing the secondary transfer belt 62 against the intermediate transfer belt 51. The recording paper 64 to which the toner image has been transferred is conveyed by the secondary transfer belt 62. The unfixed toner image transferred to the recording paper 64 is fixed by the fixing device of the present invention, which adjusts the thickness of a layer of the foamy fixing solution based upon image information from the exposing devices (not shown). Specifically, the unfixed toner image transferred to the recording paper 64 is provided with the foamy fixing solution of the present invention supplied from the toner fixing device where the thickness of a layer of the foamy fixing solution is adjusted based upon image information (such as of a color image or a black solid image) from the exposing devices (not shown). And the unfixed toner image is fixed to the recording paper 64 by means of the agent(s) included in the foamy fixing solution, i.e. the solid plasticizer and/or the liquid plasticizer, which soften(s) or swell(s) at least part of fine resin particles contained in the toner.

Next, the image forming units will be explained. In each of the image forming units 55 to 58, there are placed a charging device 67, a developing device 68, a cleaning device 69 and a charge eliminating device 70 around a photoconductor drum 66 as shown in FIG. 9B. Also, a primary transfer device 71 is provided, positioned in such a manner as to face the photoconductor drum 66, with the intermediate transfer belt 51 being sandwiched in between. The charging device 67 may be a charging device of contact charging type which employs a charging roller. The charging device 67 uniformly charges the surface of the photoconductor drum 66 by bringing the charging roller into contact with the photoconductor drum 66 and applying voltage to the photoconductor drum 66. Alternatively, as the charging device 67, a charging device of non-contact charging type which employs a non-contact-type charger such as a scorotron charger may be used. The developing device 68 allows a toner in a developer to stick to a latent electrostatic image borne on the photoconductor drum 66, thereby making the latent electrostatic image visible.

Here, the toners corresponding to the respective colors contain fine resin particles of the respective colors, and these fine resin particles are swelled or softened by the fixing solution of the present invention. Parenthetically, the developing device 68 includes an agitating portion and a developing portion (which are not shown), and a developer which was not used for development is returned to the agitating portion and thusly recycled. The concentration of the toner in the agitating portion is detected by a toner concentration sensor so as to keep the concentration constant. The primary transfer device 71 transfers the toner, which has been made visible on the photoconductor drum 66, to the intermediate transfer belt 51. In this instance, a transfer roller is employed as the primary transfer device 71, and the transfer roller is pressed against the photoconductor drum 66, with the intermediate transfer belt 51 being sandwiched in between. Note that a conductive brush, a non-contact-type corona charger, or the like may also be employed as the primary transfer device 71. The cleaning device 69 removes unnecessary toner remaining on the photoconductor drum 66. As the cleaning device 69, a blade with an end which is pressed against the photoconductor drum 66 may be used. Here, the toner removed by the cleaning device 69 is collected into the developing device 68, using a collecting screw and a toner recycling device (which are not shown), and thereby reused. The charge eliminating device 70 includes a lamp and applies light so as to initialize the surface potential of the photoconductor drum 66.

Since the image forming method and the image forming apparatus according to the present invention use the fixing solution, the fixing method and the fixing device according to the present invention, they make it possible to form a high-quality image with favorable fixing properties and without causing curling of a recording medium such as paper.

EXAMPLES

The following explains the present invention more specifically, referring to Examples and Comparative Examples. It should, however, be noted that the scope of the present invention is not confined to these Examples.

Example 1

Formulation of Fixing Solution

An agent which was solid at normal temperature and exhibited resin plasticizing capability when present in an aqueous solution, a wetting agent, a foaming agent, a foam booster and a penetrant were, in this order, added to the diluting liquid below with agitation, as each of these constituents dissolved in the diluting liquid, and a fixing solution 1 was thus prepared.

| | |
|---|---|
| Agent which was solid at normal temperature and exhibited resin plasticizing capability when present in an aqueous solution (Solid plasticizer): | |
| Polyethylene glycol #1000 ($HO—(C_2H_4O)_n—H$, n = 20, weight average molecular weight: 950 to 1,050, manufactured by KANTO CHEMICAL CO., INC.) | 20% by mass |
| Foaming agent | |
| Myristic acid triethanolamine salt | 2.3% by mass |
| Palmitic acid triethanolamine salt | 1.1% by mass |
| Stearic acid triethanolamine salt | 0.6% by mass |
| Foam booster | |
| Fatty acid alkanolamide ("MARPON MM", manufactured by Matsumoto Yushi-Seiyaku Co., Ltd) | 0.5% by mass |
| Penetrant | |
| Polyoxyethylene (POE) alkyl ether surfactant ("BT-12", manufactured by Nikko Chemicals Co., Ltd.) | 0.5% by mass |
| Wetting agent | |
| Glycerin | 5% by mass |
| Diluting liquid | |
| Ion-exchange water | 70% by mass |

<Production of Unfixed Toner Image>

An image with commercially available electrophotographic polymerized toners was formed on PPC paper ("MY PAPER", A4 size, manufactured by Ricoh Company, Ltd.), using a color MFP (multi-function printer) (IMAGIO MP3300, manufactured by Ricoh Company, Ltd.). Also, an image with commercially available electrophotographic pulverized toners was formed on PPC paper ("MY PAPER", A4 size, manufactured by Ricoh Company, Ltd.), using a color printer (IPSiO CX8200, manufactured by Ricoh Company, Ltd.). The thickness of each toner layer was in the range of 30 μm to 40 μm. Each formed image was a red solid image in which a yellow toner layer was laid on a magenta toner layer, with the total amount of the toners being 0.7 mg/cm$^2$.

The commercially available polymerized toners used were as follows.

Magenta toner: IMAGIO MP SPOT TONER MAGENTA C3000, manufactured by Ricoh Company, Ltd.

Yellow toner: IMAGIO MP SPOT TONER YELLOW C3000, manufactured by Ricoh Company, Ltd.

The commercially available pulverized toners used were as follows.

Magenta toner: IPSIO TONER MAGENTA TYPE 8000, manufactured by Ricoh Company, Ltd.

Yellow toner: IPSIO TONER YELLOW TYPE 8000, manufactured by Ricoh Company, Ltd.

<Application of Foamy Fixing Solution>

—Fixing Solution Providing Unit—

The fixing solution 1 was rendered into a foamy fixing solution, using the device shown in FIGS. 4A and 4B which included the following components. The thickness of a layer of the foamy fixing solution on an applicator roller was approximately 70 μm.

Pressurizing Roller: a sponge roller including an aluminum alloy roller (10 mm in diameter) as a metal core and a polyurethane foam material ("COLORFOAM EMO" (product name), manufactured by INOAC CORPORATION) (50 mm in outer diameter) formed on the metal core Applicator roller: an SUS roller (30 mm in diameter) with a PFA resin applied thereto with firing, which was designed to move at a linear velocity of 300 mm/s Layer thickness adjusting blade: an aluminum alloy support plate with 1-mm-thick plate glass stuck thereto, whose glass surface was oriented toward the applicator roller such that the gap between the applicator roller and the glass surface could be adjusted to the range of 10 μm to 100 μm Paper conveyance speed: 300 mm/s Gap between applicator roller and layer thickness adjusting blade: 40 μm The obtained foamy fixing solution was applied over the toner layers which had been formed on the PPC paper as described above, such that its amount over the entire surface of the A4 size paper was approximately 200 mg in one case and approximately 300 mg in another case.

Next, color reproducibility, fixation capability and tackiness regarding Example 1 were evaluated as follows. The results are shown in Table 1.

<Color Reproducibility>

The L' value, the a*' value and the b*' value of each fixed image obtained by the above-mentioned fixation were measured. Also, the L value, the a* value and the b* value of a fixed image produced by fixing an unfixed image (which had been obtained as described above) in accordance with a conventional thermal fixing method (fixing temperature: 150° C. to 200° C.) were measured as well. The color difference ΔE was calculated in accordance with Equation 2 below, using the obtained values. Note that when ΔE is five or less, the color reproducibility is deemed to be much the same as the color reproducibility in the case of thermal fixation.

$$\Delta E=\sqrt{((L-L')^2+(a^*-a^{*\prime})^2+(b^*-b^{*\prime})} \quad \text{<Equation 2>}$$

<Evaluation of Fixation Capability>

The fixation capability of each fixed image obtained by the above-mentioned fixation was evaluated using a clock meter tester. Specifically, cotton cloth was rubbed against the fixed image, the concentration of smears at the rubbed portion of the cotton cloth was measured using the reflective concentration meter X-RITE 938, and the fixation capability was judged based upon the extent of the smears (the smaller the extent of the smears is, the better). When the concentration of the smears on the cotton cloth is 0.15 or less, the smears are not conspicuous, and so the fixation capability is deemed to be favorable.

<Tack Value (Tackiness)>

The tack value of each fixed image obtained by the above-mentioned fixation was measured using a tack meter tensile tester (manufactured by Rhesca Corporation). Specifically, using a sample similar to the one in the evaluation of fixation capability, a cylindrical stainless steel probe (diameter: 8.0 mm) was pressed with a compressive load of 100 gf for 20 seconds against the image portion (the toners on the recording medium) to which the foamy fixing solution had been applied. Thereafter, the probe was pulled off at a rate of 120 mm/min, and the stress (Pa) applied at the time of the pulling was measured. The value of the stress was defined as the tack value. Note that when the tack value is 4E+02 Pa (or 4 gf/cm$^2$) or less, there is virtually no tack, and so it is deemed that the fixation can be performed without adhesiveness being felt.

Here, the symbol "E" means that the value which follows "E" is an exponent, with the base being 10, and that the value shown before "E" is multiplied by the exponential function with the base 10. For example, "4E+02" means "$4\times10^2=400$".

Comparative Example 1

The same process as in Example 1 was carried out except that dicarbitol succinate (product name: HAIAQUE-OUSTER DCS, manufactured by Kokyu Alcohol Kogyo Co., Ltd.) as a liquid plasticizer was used instead of the polyethylene glycol #1000 (there was no change in concentration). The fixing solution prepared is referred to as "comparative fixing solution 1". The results are shown in Table 1.

TABLE 1

| | Fixing solution | Toner | Application amount (mg/A4) | ΔE (Color reproducibility) | Concentration of smear on cotton cloth (Fixation capability) | Tack value (1E+02 Pa or gf/cm$^2$) |
|---|---|---|---|---|---|---|
| Ex. 1 | Fixing solution 1 | Polymerized toner | 200 | 10 | 0.10 | 3.6 |
| | | | 300 | 3 | 0.09 | 3.8 |
| | | Pulverized toner | 200 | 9 | 0.08 | 3.4 |
| | | | 300 | 2 | 0.09 | 3.7 |

TABLE 1-continued

| | Fixing solution | Toner | Application amount (mg/A4) | ΔE (Color reproducibility) | Concentration of smear on cotton cloth (Fixation capability) | Tack value (1E+02 Pa or gf/cm$^2$) |
|---|---|---|---|---|---|---|
| Comp. Ex. 1 | Comparative fixing solution 1 | Polymerized toner | 200 | 10 | 0.12 | 10.5 |
| | | | 300 | 3 | 0.35 | 42.3 |
| | | Pulverized toner | 200 | 8 | 0.22 | 9.3 |
| | | | 300 | 2 | 0.36 | 32.1 |

The results in Table 1 demonstrate that, in Comparative Example 1, as the application amount increased, the color reproducibility improved, but the tackiness became great. In addition, the fixation capability degraded. Meanwhile, in Example 1, as the application amount increased, the color reproducibility improved; also, the fixation capability was favorable and the tackiness was slight. Thus, Example 1 made it possible to obtain superior fixation quality and prevent the problems seen in related art.

Example 2

The same process as in Example 1 was carried out except that polyethylene glycol #2000 (HO—($C2H_4O$)—H, n=40, weight average molecular weight: 1,850 to 2,150, manufactured by KANTO CHEMICAL CO., INC.) was used instead of the polyethylene glycol #1000 and the amount of the ion-exchange water was changed from 70% by mass to 65% by mass. A fixing solution 2 was thus prepared.

This fixing solution was provided in the form of foam as in Example 1, using the device shown in FIG. 8 instead of the device shown in FIGS. 4A and 4B. After the provision of the fixing solution, the toner-attached paper was passed through a nip portion such that unfixed toner layers came into contact with a pressurizing roller that was a hollow rubber roller (rubber hardness: 20 degrees) housing an infrared heater and being positioned at a distance of 50 mm from the exit of a nip portion (where an applicator roller came into contact with the paper after the application of the fixing solution), with the surface temperature on the pressurizing roller being set at 60° C. The nip width was 10 mm and the linear velocity was 100 mm/s (which was the same as the paper conveyance speed in an application device).

Fixed images were obtained in the same manner as in Example 1 except for the foregoing points. The evaluations were carried out on these obtained fixed images as in Example 1. The results are shown in Table 2.

TABLE 2

| | Fixing solution | Toner | Application amount (mg/A4) | ΔE (Color reproducibility) | Concentration of smear on cotton cloth (Fixation capability) | Tack value (1E+02 Pa or gf/cm$^2$) |
|---|---|---|---|---|---|---|
| Ex. 2 | Fixing solution 2 | Polymerized toner | 200 | 7 | 0.10 | 3.6 |
| | | | 300 | 4 | 0.09 | 3.8 |
| | | Pulverized toner | 200 | 5 | 0.08 | 3.4 |
| | | | 300 | 2 | 0.09 | 3.7 |

The results in Table 2 demonstrate that the fixing solution 2 (notably with the pulverized toner) was excellent in color reproducibility and satisfactory in terms of fixation capability and tackiness, thereby exhibiting superior fixing performance.

Example 3

A fixing solution was prepared as in Example 1. This fixing solution is referred to as "fixing solution 3".

Toner layers were formed on the PPC paper as in Example 1, using the polymerized toners and the pulverized toners.

Fixed images were obtained as in Example 1, using the fixing solution 3, the polymerized toners and the pulverized toners. In this Example, the amount of the foamy fixing solution provided was adjusted only to 200 mg.

The evaluations were carried out on these obtained fixed images as in Example 1. The results are shown in Table 3.

Example 4

Fixed images were obtained in the same manner as in Example 3 except that a fixing solution 4 (in which the amount of the polyethylene glycol #1000 was changed from 20% by mass to 30% by mass) was used and the amount of the ion-exchange water was changed from 70% by mass to 60% by mass. The evaluations were carried out on these obtained fixed images as in Example 1. The results are shown in Table 3.

Example 5

The same process as in Example 3 was carried out except that a fixing solution 5 prepared using the polyethylene glycol #2000 (manufactured by KANTO CHEMICAL CO., INC.) instead of the polyethylene glycol #1000 was used and only a fixed image of the pulverized toners was obtained. The evaluations were carried out on this obtained fixed image as in Example 1. The results are shown in Table 3.

Example 6

A fixed image was obtained in the same manner as in Example 5 except that a fixing solution 6 (in which the amount of the polyethylene glycol #2000 was changed from 20% by mass to 30% by mass) was used and the amount of the ion-exchange water was changed from 70% by mass to 60% by mass. The evaluations were carried out on this obtained fixed image as in Example 1. The results are shown in Table 3.

Example 7

A fixed image was obtained in the same manner as in Example 5 except that a fixing solution 7 prepared using polyethylene glycol #4000 ($HO—(C_2H_4O)_n—H$, n=60, weight average molecular weight: 2,700 to 3,400, manufactured by KANTO CHEMICAL CO., INC.) instead of the polyethylene glycol #2000 was used. The evaluations were carried out on this obtained fixed image as in Example 1. The results are shown in Table 3.

Example 8

A fixed image was obtained in the same manner as in Example 6 except that a fixing solution 8 prepared using the polyethylene glycol #4000 (manufactured by KANTO CHEMICAL CO., INC.) instead of the polyethylene glycol #2000 was used. The evaluations were carried out on this obtained fixed image as in Example 1. The results are shown in Table 3.

Comparative Example 3

Fixed images were obtained in the same manner as in Example 4 except that a comparative fixing solution 2 prepared using the dicarbitol succinate (product name: HAIAQUEOUSTER DCS, manufactured by Kokyu Alcohol Kogyo Co., Ltd.) instead of the polyethylene glycol #1000 was used. The evaluations were carried out on these obtained fixed images as in Example 1. The results are shown in Table 3.

Comparative Example 4

A fixed image was obtained in the same manner as in Example 5 except that only a fixed image of the polymerized toners was obtained. The evaluations were carried out on this obtained fixed image as in Example 1. The results are shown in Table 3.

Comparative Example 5

A fixed image was obtained in the same manner as in Example 6 except that only a fixed image of the polymerized toners was obtained. The evaluations were carried out on this obtained fixed image as in Example 1. The results are shown in Table 3.

Comparative Example 6

A fixed image was obtained in the same manner as in Example 7 except that only a fixed image of the polymerized toners was obtained. The evaluations were carried out on this obtained fixed image as in Example 1. The results are shown in Table 3.

Comparative Example 7

A fixed image was obtained in the same manner as in Example 8 except that only a fixed image of the polymerized toners was obtained. The evaluations were carried out on this obtained fixed image as in Example 1. The results are shown in Table 3.

TABLE 3

| | Toner | Fixing solution | ΔE (Color reproducibility) | Concentration of smear on cotton cloth (Fixation capability) | Tack value (1E+02 Pa or gf/cm$^2$) |
|---|---|---|---|---|---|
| Ex. 3 | Pulverized toner | Fixing solution 3 | 3.9 | 0.10 | 2.3 |
| | Polymerized toner | | 4.1 | 0.11 | 2.8 |
| Ex. 4 | Pulverized toner | Fixing solution 4 | 3.8 | 0.12 | 2.6 |
| | Polymerized toner | | 4.3 | 0.11 | 2.8 |
| Ex. 5 | Pulverized toner | Fixing solution 5 | 4.9 | 0.12 | 2.7 |
| Ex. 6 | Pulverized toner | Fixing solution 6 | 4.8 | 0.12 | 2.6 |
| Ex. 7 | Pulverized toner | Fixing solution 7 | 4.9 | 0.11 | 2.5 |
| Ex. 8 | Pulverized toner | Fixing solution 8 | 4.8 | 0.12 | 2.4 |
| Comp. Ex. 3 | Pulverized toner | Comparative fixing | 2.1 | 0.25 | 9.6 |
| | Polymerized toner | solution 2 | 4.5 | 0.34 | 10.5 |
| Comp. Ex. 4 | Polymerized toner | Fixing solution 5 | 25.7 | 0.35 | 2.2 |
| Comp. Ex. 5 | Polymerized toner | Fixing solution 6 | 25.0 | 0.36 | 2.3 |
| Comp. Ex. 6 | Polymerized toner | Fixing solution 7 | 29.5 | 0.38 | 2.2 |
| Comp. Ex. 7 | Polymerized toner | Fixing solution 8 | 28.7 | 0.38 | 2.3 |

The results in Table 3 demonstrate that the polyethylene glycol #1000 in Examples 3 and 4 made it possible to achieve superior color reproducibility and enabled fixation without tack being felt, regardless of its concentration in the fixing solution and the type of the toner used. The polyethylene glycols #2000 and #4000 in Examples 5 to 8 (when the pulverized toners were used) made it possible to achieve superior color reproducibility and enabled fixation without tack being felt, regardless of their concentration in the fixing solution.

Example 9

Fixed images were obtained in the same manner as in Example 2 except that the fixing solution 5 prepared in Example 5 was used and the surface temperature on the pressurizing roller was changed from 60° C. to 65° C. in one case and changed from 60° C. to 75° C. in another case. The evaluations were carried out on these obtained fixed images as in Example 1. The results are shown in Table 4.

Example 10

Fixed images were obtained in the same manner as in Example 9 except that the fixing solution 6 was used instead of the fixing solution 5. The evaluations were carried out on these obtained fixed images as in Example 1. The results are, shown in Table 4.

Example 11

Fixed images were obtained in the same manner as in Example 9 except that the fixing solution 7 was used instead of the fixing solution 5. The evaluations were carried out on these obtained fixed images as in Example 1. The results are shown in Table 4.

Example 12

Fixed images were obtained in the same manner as in Example 9 except that the fixing solution 8 was used instead of the fixing solution 5. The evaluations were carried out on these obtained fixed images as in Example 1. The results are shown in Table 4.

Comparative Example 8

Fixed images were obtained in the same manner as in Example 9 except that no fixing solution was applied and the surface temperature on the pressurizing roller was set at 65° C. in one case, at 75° C. in another case and at 135° C. in yet another case. The evaluations were carried out on these obtained fixed images as in Example 1. The results are shown in Table 4.

TABLE 4

| | Toner | Fixing solution | Surface temperature on pressurizing roller (° C.) | ΔE (Color reproducibility) | Concentration of smear on cotton cloth (Fixation capability) | Tack value (1E+02 Pa or gf/cm$^2$) |
|---|---|---|---|---|---|---|
| Ex. 9 | Polymerized toner | Fixing solution 5 | 65 | 4.5 | 0.11 | 3.5 |
| | Polymerized toner | | 75 | 1.4 | 0.13 | 3.9 |
| Ex. 10 | Polymerized toner | Fixing solution 6 | 65 | 3.5 | 0.13 | 4.1 |
| | Polymerized toner | | 75 | 1.8 | 0.12 | 4.2 |
| Ex. 11 | Polymerized toner | Fixing solution 7 | 65 | 4.9 | 0.12 | 2.5 |
| | Polymerized toner | | 75 | 2.3 | 0.12 | 2.7 |
| Ex. 12 | Polymerized toner | Fixing solution 8 | 65 | 4.3 | 0.11 | 3.2 |
| | Polymerized toner | | 75 | 2.1 | 0.12 | 3.4 |
| Comp. Ex. 8 | Polymerized toner | Not applied | 65 | 29.0 | 0.44 | 1.2 |
| | Polymerized toner | | 75 | 23.4 | 0.41 | 1.3 |
| | Polymerized toner | | 135 | 0.3 | 0.09 | 1.2 |

The results of Table 4 demonstrate that Examples 9 to 12 made it possible to achieve superior color reproducibility and enabled fixation without tack being felt, even when the surface temperature on the pressurizing roller was lower than the surface temperature in Comparative Example 8 by 60° C. or more.

Example 13

A fixing solution was prepared in the same manner as in Example 2 except that polyethylene glycol #6000 (HO—$(C_2H_4O)_n$—H, n=80, weight average molecular weight: 7,300 to 10,200, manufactured by KANTO CHEMICAL CO., INC.) was used instead of the polyethylene glycol #2000. This fixing solution was provided in the form of foam as in Example 2, which was followed by heating at 60° C., and fixed images were thus formed. The evaluations were carried out on these obtained fixed images as in Example 1. The results are shown in Table 5.

Example 14

A fixing solution was prepared in the same manner as in Example 1 except that a polyoxyethylene alkyl ether (10% by mass) ($C_{17}H_{35}$—O—$(C_2H_4O)_n$—H, n=13, EMULGEN 420, manufactured by Kao Corporation) was used instead of the polyethylene glycol #1000 (20% by mass). This fixing solution was provided in the form of foam as in Example 1, which was followed by heating at 60° C., and fixed images were thus formed. The evaluations were carried out on these obtained fixed images as in Example 1. The results are shown in Table 5.

Example 15

A fixing solution was prepared in the same manner as in Example 1 except that a polyoxyethylene alkyl ether (10% by mass) ($C_{18}H_{37}$—O—$(C_2H_4O)_n$—H, n=50, EMULGEN 350, manufactured by Kao Corporation) was used instead of the polyethylene glycol #1000 (20% by mass). This fixing solution was provided in the form of foam as in Example 2, which was followed by heating at 60° C., and fixed images were thus formed. The evaluations were carried out on these obtained fixed images as in Example 1. The results are shown in Table 5.

Example 16

A fixing solution was prepared in the same manner as in Example 1 except that a polyoxyethylene alkyl ether (10% by mass) ($C_{14}H_{29}$—O—$(C_2H_4O)_n$—H, EMULGEN 4085, manufactured by Kao Corporation) was used instead of the polyethylene glycol #1000 (20% by mass). This fixing solution was provided in the form of foam as in Example 1, which was followed by heating at 60° C., and fixed images were thus formed. The evaluations were carried out on these obtained fixed images as in Example 1. The results are shown in Table 5.

Example 17

A fixing solution was prepared in the same manner as in Example 1 except that a polyoxyethylene alkyl ether (10% by mass) ($C_{18}H_{37}$—O—$(C_2H_4O)_n$—H, n=20, EMALEX 620 (STEARETH-20), manufactured by Nihon Emulsion Co., Ltd.) was used instead of the polyethylene glycol #1000 (20% by mass). This fixing solution was provided in the form of foam as in Example 2, which was followed by heating at 60° C., and fixed images were thus formed. The evaluations were carried out on these obtained fixed images as in Example 1. The results are shown in Table 5.

Example 18

A fixing solution was prepared in the same manner as in Example 1 except that a polyoxyethylene fatty acid ester (3% by mass) ($C_{18}H_{37}$—COO—$(C_2H_4O)_n$—H, n=140, EMANON 3199V, manufactured by Kao Corporation) was used instead of the polyethylene glycol #1000 (20% by mass). This fixing solution was provided in the form of foam as in Example 1, which was followed by heating at 60° C., and fixed images were thus formed. The evaluations were carried out on these obtained fixed images as in Example 1. The results are shown in Table 5.

Example 19

A fixing solution was prepared in the same manner as in Example 1 except that a polyoxyethylene fatty acid diester (3% by mass) ($C_{18}H_{37}$—COO—$(C_2H_4O)_n$—CO—$C_{18}H_{37}$, n=140, EMANON 3299V, manufactured by Kao Corporation) was used instead of the polyethylene glycol #1000 (20% by mass). This fixing solution was provided in the form of foam as in Example 1, which was followed by heating at 60° C., and fixed images were thus formed. The evaluations were carried out on these obtained fixed images as in Example 1. The results are shown in Table 5.

Example 20

A fixing solution was prepared in the same manner as in Example 1 except that a polyoxyethylene fatty acid diester (3% by mass) ($C_{18}H_{37}$—COO—$(C_2H_4O)_n$—CO—$C_{18}H_{37}$, n=250, EMANON 3299RV, manufactured by Kao Corporation) was used instead of the polyethylene glycol #1000 (20% by mass). This fixing solution was provided in the form of foam as in Example 2, which was followed by heating at 60° C., and fixed images were thus formed. The evaluations were carried out on these obtained fixed images as in Example 1. The results are shown in Table 5.

Example 21

A fixing solution was prepared in the same manner as in Example 1 except that a polyoxyethylene polyoxypropylene glycol (3% by mass) (HO—$(C_2H_4O)_n$—$(C_3H_6O)_m$—H, n=160, m=30, EMULGEN PP-290, manufactured by Kao Corporation) was used instead of the polyethylene glycol #1000 (20% by mass). This fixing solution was provided in the form of foam as in Example 2, which was followed by heating at 60° C., and fixed images were thus formed. The evaluations were carried out on these obtained fixed images as in Example 1. The results are shown in Table 5.

TABLE 5

| | Application amount (mg/A4) | ΔE (Color reproducibility | Concentration of smear on cotton cloth (Fixation capability) | Tack value (1E+02 Pa or gf/cm$^2$) |
|---|---|---|---|---|
| Ex. 13 | 200 | 5 | 0.07 | 3.6 |
| | 300 | 4 | 0.06 | 3.5 |
| Ex. 14 | 200 | 6 | 0.08 | 4.5 |
| | 300 | 4 | 0.06 | 5.6 |
| Ex. 15 | 200 | 6 | 0.09 | 3.9 |
| | 300 | 3 | 0.08 | 4.3 |
| Ex. 16 | 200 | 5 | 0.11 | 3.8 |
| | 300 | 4 | 0.07 | 4.0 |
| Ex. 17 | 200 | 5 | 0.09 | 3.6 |
| | 300 | 5 | 0.08 | 3.9 |
| Ex. 18 | 200 | 4 | 0.12 | 4.0 |
| | 300 | 4 | 0.09 | 4.2 |
| Ex. 19 | 200 | 6 | 0.08 | 3.9 |
| | 300 | 5 | 0.07 | 4.0 |
| Ex. 20 | 200 | 5 | 0.09 | 3.5 |
| | 300 | 4 | 0.08 | 3.9 |
| Ex. 21 | 200 | 5 | 0.11 | 3.7 |
| | 300 | 4 | 0.09 | 3.9 |
| Comp. | 200 | 10 | 0.12 | 10.5 |
| Ex. 1 | 300 | 3 | 0.35 | 42.3 |

The results of Table 5 demonstrate that, in comparison with Comparative Example 1, Examples 13 to 21 yielded superior color reproducibility and superior fixation capability and enabled fixation without tack being felt.

A fixing solution of the present invention can be suitably used as a fixing solution usable in an electrophotographic formation technique which employs a non-thermal fixing method.

What is claimed is:

1. A fixing solution for fixing fine resin particles to a recording medium, the fixing solution comprising:

a diluent which contains water;

a foaming agent which allows the fixing solution to be in the form of foam; and a solid plasticizer which is solid at normal temperature and soluble in the diluent, and which softens or swells at least part of the fine resin particles while dissolved in the diluents, wherein the solid plasticizer changes into a solid state when an amount of the diluent in the fixing solution decreases.

2. The fixing solution according to claim 1, wherein the solid plasticizer contains a functional group which has an affinity for the fine resin particles.

3. The fixing solution according to claim 1, wherein the solid plasticizer is a compound which contains at least one of an ethylene oxide group and a propylene oxide group.

4. The fixing solution according to claim 3, wherein the compound which contains the ethylene oxide group is any one of the compounds represented by General Formulae (1) to (5) below:

$$HO—(CH_2CH_2O)_n—H \quad (1)$$

wherein n denotes an integer of 10 to 100, $$HO—(CH_2CH_2O)_n(CH(CH_3)CH_2O)_m—H \quad (2)$$

wherein n denotes an integer of 10 to 20 and in denotes an integer of 5 to 50, $$R—O—(CH_2CH_2O)_n—H \quad (3)$$

wherein n denotes an integer of 10 to 100, $$R—COO—(CH_2CH_2O)_n—H \quad (4)$$

where R denotes a C10-C22 straight-chain or branched alkyl group, and n denotes an integer of 10 to 100, $$R—COO—(CH_2CH_2O)_n—CO—R' \quad (5)$$

wherein R and R' each independently denote a C10-C22 straight-chain or branched alkyl group, and n denotes an integer of 10 to 100.

5. The fixing solution according to claim 4, wherein the compound is polyethylene glycol which has a weight average molecular weight of 1,000 to 10,000.

6. The fixing solution according to claim 1, wherein the fine resin particles are particles of a polyester resin having at least one of an ethylene oxide group and a propylene oxide group in a resin molecule.

7. The fixing solution according to claim 6, wherein the polyester resin is a polyol polyester resin.

8. The fixing solution according to claim 1, wherein the fine resin particles constitute a toner.

9. The fixing solution according to claim 1, wherein in a case that the solid plasticizer is present in the fixing solution in a state of foam, the solid plasticizer is in a melted state, and the solid plasticizer changes into the solid state when the amount of the diluent in the fixing solution decreases.

10. The fixing solution according to claim 1, wherein when the fixing solution is provided to the fine resin particles, the solid plasticizer changes into the solid state.

11. A fixing method comprising:

rendering a fixing solution into the for so as to produce a foamy fixing solution;

adjusting the thickness of a layer of the foamy fixing solution such that the layer having a desired thickness forms over a contact surface of a foamy fixing solution providing unit; and providing the formed layer of the foamy fixing solution having the desired thickness to a fine resin particle layer on a medium, wherein the fixing solution is a fixing solution for fixing fine resin particles to a recording medium and comprises:

a diluent which contains water;

a foaming agent which allows the fixing solution to be in the form of foam; and a solid plasticizer which is solid at normal temperature and soluble in the diluent, and which softens or swells at least part of the fine resin particles while dissolved in the diluents;

wherein the solid plasticizer changes into a solid state when an amount of the diluent in the fixing solution decreases.

12. A fixing device comprising:

a foamy fixing solution producing unit configured to render a fixing solution into the form of foam so as to produce a foamy fixing solution;

a foamy fixing solution providing unit configured to provide the foamy fixing solution to a fine resin particle layer on a medium; and a layer thickness adjusting unit configured to adjust the thickness of a layer of the foamy fixing solution on the foamy fixing solution providing unit;

wherein the fixing solution is a fixing solution for fixing fine resin particles to a recording medium and comprises:

a diluent which contains water;

a foaming agent which allows the fixing solution to be in the form of foam, and a solid plasticizer which is solid at normal temperature and soluble in the diluent, and which softens or swells at least part of the fine resin particles while dissolved in the diluent;

wherein the solid plasticizer changes into a solid state when an amount of the diluent in the fixing solution decreases.

* * * * *